US008570314B2

(12) United States Patent
Hasegawa et al.

(10) Patent No.: US 8,570,314 B2
(45) Date of Patent: Oct. 29, 2013

(54) EMISSIVE TYPE DISPLAY DEVICE, SEMICONDUCTOR DEVICE, ELECTRONIC DEVICE, AND POWER SUPPLY LINE DRIVING METHOD

(75) Inventors: Hiroshi Hasegawa, Kanagawa (JP); Teppei Isobe, Kanagawa (JP)

(73) Assignee: Sony Corporation, Tokyo (JP)

( * ) Notice: Subject to any disclaimer, the term of this patent is extended or adjusted under 35 U.S.C. 154(b) by 1015 days.

(21) Appl. No.: 12/591,368

(22) Filed: Nov. 18, 2009

(65) Prior Publication Data

US 2010/0149167 A1 Jun. 17, 2010

(30) Foreign Application Priority Data

Dec. 17, 2008 (JP) ..... 2008-321653

(51) Int. Cl.
*G09G 5/00* (2006.01)

(52) U.S. Cl.
USPC ..... 345/213; 345/205; 345/208; 345/209; 345/211; 345/212

(58) Field of Classification Search
USPC ..... 345/76–83, 690, 204–213; 315/169.1–169.3, 291; 313/584, 585
See application file for complete search history.

(56) References Cited

U.S. PATENT DOCUMENTS 6,147,664 A * 11/2000 Hansen ..... 345/74.1
6,949,879 B1 * 9/2005 Wright et al. ..... 313/504
6,963,175 B2 * 11/2005 Archenhold et al. ..... 315/291
7,382,342 B2 * 6/2008 Uchino et al. ..... 345/92
7,973,747 B2 * 7/2011 Ono et al. ..... 345/79
8,063,920 B2 * 11/2011 De Haan et al. ..... 345/690
8,149,185 B2 * 4/2012 Uchino et al. ..... 345/76
8,159,479 B2 * 4/2012 Uchino et al. ..... 345/204
2003/0057888 A1 * 3/2003 Archenhold et al. ..... 315/291
2004/0263045 A1 * 12/2004 Smith et al. ..... 313/373
2005/0012736 A1 * 1/2005 Uchino et al. ..... 345/211
2005/0068270 A1 * 3/2005 Awakura et al. ..... 345/76
2005/0212787 A1 * 9/2005 Noguchi et al. ..... 345/204
2005/0219272 A1 * 10/2005 Johnson et al. ..... 345/690
2006/0187154 A1 * 8/2006 Tsuchida ..... 345/76
2006/0208974 A1 * 9/2006 Hara ..... 345/76
2007/0080911 A1 * 4/2007 Liu et al. ..... 345/82
2007/0229413 A1 * 10/2007 Hara ..... 345/76
2007/0279403 A1 * 12/2007 Uchino et al. ..... 345/205
2008/0018632 A1 * 1/2008 Cordes et al. ..... 345/208
2009/0097291 A1 * 4/2009 Bormann ..... 363/126
2009/0187925 A1 * 7/2009 Hu et al. ..... 719/327
2011/0074839 A1 * 3/2011 Liu et al. ..... 345/690

FOREIGN PATENT DOCUMENTS

JP 2003-228331 8/2003

* cited by examiner

*Primary Examiner* — Prabodh M Dharia
(74) *Attorney, Agent, or Firm* — Rader, Fishman & Grauer PLLC

(57) ABSTRACT

An emissive type display device includes: a pixel array section having pixels ready for an active matrix driving system; a circuit for setting a peak luminance level of each display frame; and a driving circuit for variably controlling a total application period length of a driving voltage applied to a power supply line connected to each pixel and amplitude of the driving voltage so as to obtain a set peak luminance level, when the set peak luminance level is lower than a set value, the driving circuit dividing the driving voltage into a plurality of times of pulse waveform, and variably controlling the amplitude of the driving voltage at each output time according to the peak luminance level such that the amplitude of the driving voltage at least one output time is lower than a maximum driving voltage in a non-emission period.

12 Claims, 42 Drawing Sheets

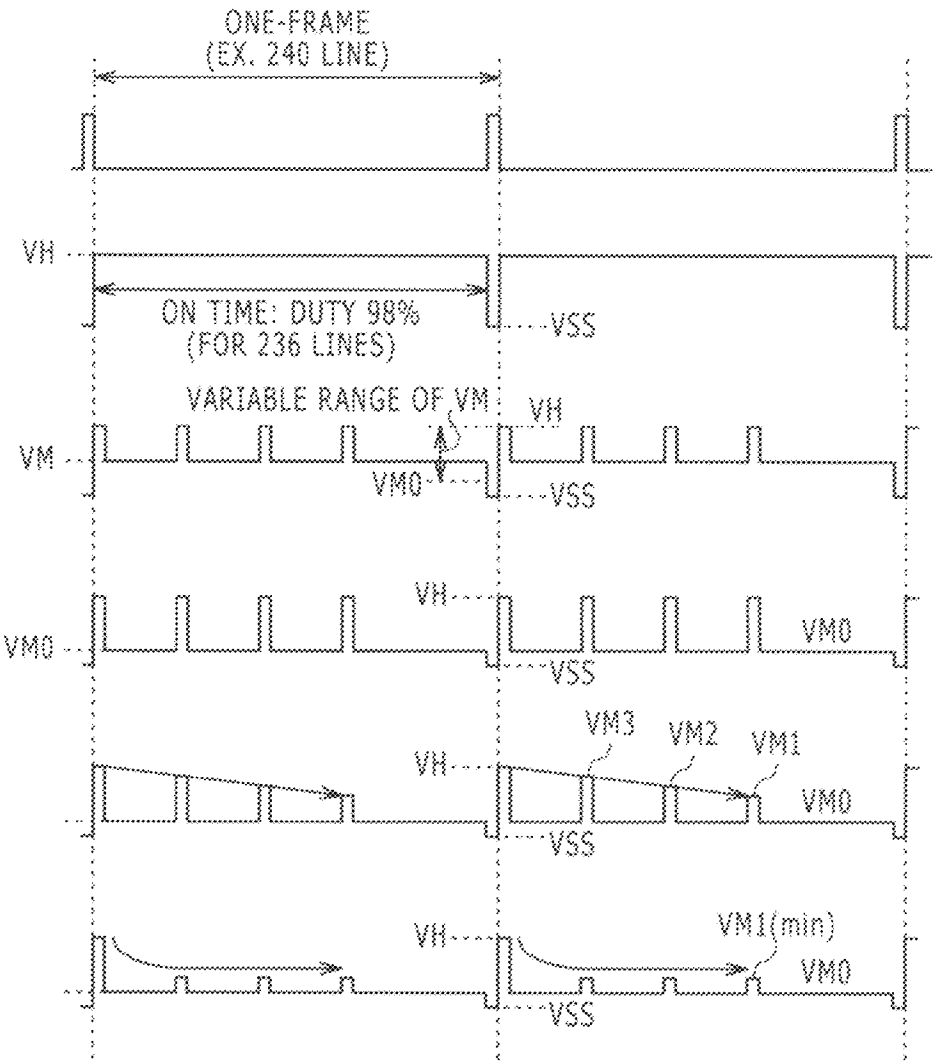
FIG.13A FRAME PULSE
FIG.13B MAXIMUM LUMINANCE MODE
FIG.13C INTERMEDIATE LUMINANCE MODE
FIG.13D LOW LUMINANCE MODE
FIG.13E LOWEST LUMINANCE MODE (1)
FIG.13F LOWEST LUMINANCE MODE (2)

LOW
LUMINANCE MODE

LOWEST
LUMINANCE MODE (1)

LOWEST
LUMINANCE MODE (2)

LOWEST
LUMINANCE MODE (3)

LOWEST
LUMINANCE MODE (4)

LOWEST
LUMINANCE MODE (5)

LOWEST
LUMINANCE MODE (6)

FIG.31

| 121 | 123 | 125 |
|---|---|---|
| LUMINANCE DIFFERENCE | MOTION VECTOR DIRECTION | MOTION VECTOR MAGNITUDE |

FIG.32

| MOTION QUANTITY (PIXEL PER FRAME) | MOTION VALUE |
|---|---|
| 0 | 1.0 |
| 1 | 1.1 |
| 2 | 1.2 |
| 3 | 1.3 |
| 4 | 1.4 |
| 5 OR MORE | 1.5 |

97

FIG.37

| LUMINANCE LEVEL (%) | LUMINANCE LEVEL VALUE |
|---|---|
| 50 TO 55 | 1.0 |
| 55 TO 60 | 0.9 |
| 60 TO 65 | 0.8 |
| 65 TO 70 | 0.7 |
| 70 TO 75 | 0.6 |
| 75 OR MORE | 0.5 |

137

FIG.40

| FRAME RATE [Hz] | FRAME RATE VALUE |
|---|---|
| 65 OR MORE | 0 |
| 64 | 0.2 |
| 63 | 0.3 |
| 62 | 0.5 |
| 61 | 0.7 |
| 60 | 1.0 |
| 59 | 1.5 |
| 58 | 2.0 |
| 57 | 2.5 |
| 56 | 3.0 |
| 55 | 3.5 |
| 54 OR LOWER | 4.0 |

103

FIG.41

| AREA (%) | AREA VALUE |
|---|---|
| LESS THAN 10 | 0 |
| 10 TO 15 | 1.0 |
| 15 TO 20 | 1.1 |
| 20 TO 25 | 1.2 |
| 25 TO 30 | 1.3 |
| 30 TO 35 | 1.4 |
| 35 TO 40 | 1.5 |
| 40 TO 45 | 1.6 |
| 45 TO 50 | 1.8 |
| 50 OR MORE | 2.0 |

103

FIG.42

| EMISSION TIME [SEC] | EMISSION TIME VALUE |
|---|---|
| LESS THAN 1 | 0 |
| 1.0 | 1.0 |
| 1.1 | 1.1 |
| 1.2 | 1.2 |
| 1.3 | 1.3 |
| 1.4 | 1.4 |
| 1.5 | 1.5 |
| 1.6 | 1.6 |
| 1.7 | 1.7 |
| 1.8 | 1.8 |
| 1.9 | 1.9 |
| 2 OR MORE | 2.0 |

103

FIG.43

| FLICKER INFORMATION | DRIVING MODE |
|---|---|
| 0 TO 8 | MOVING IMAGE IMPROVING MODE |
| 8 TO 14 | BALANCE MODE |
| 14 TO 16 | FLICKER REMEDYING MODE |

85

181

EMISSIVE TYPE DISPLAY DEVICE, SEMICONDUCTOR DEVICE, ELECTRONIC DEVICE, AND POWER SUPPLY LINE DRIVING METHOD

BACKGROUND OF THE INVENTION

1. Field of the Invention

The invention described in the present specification relates to a display panel having self-luminous elements arranged in the form of a matrix on the panel, and a panel module having a driving circuit mounted in the display panel. In the present specification, the display panel and the panel module will both be referred to as an emissive type display device. In addition, the invention in the present specification has aspects of a semiconductor device, an electronic device, and a power supply line driving method.

2. Description of the Related Art

One of basic performance requirements of a display is brightness (luminance). Therefore, recent displays (for example liquid crystal displays, plasma displays, and organic EL (Electro Luminescence) displays) are expected naturally to have high luminance irrespective of difference in display system.

On the other hand, a display that emits light at a maximum luminance at all times has a problem of being too bright and glaring rather than offering high performance. Further, this kind of display consumes a large amount of power, and is inferior in terms of environmental performance.

Accordingly, a method of properly using a maximum luminance (peak luminance) and average luminance (all-white luminance) is employed for displays. This method has been used since displays of a cathode-ray tube type were mainstream.

However, a controlling method of the cathode-ray tube type display greatly differs from the recent displays due to differences in light emission principles and driving method.

In the case of a plasma display, for example, the maximum luminance and the average luminance are controlled by securing a wide dynamic range of video signal level. In the case of a liquid crystal display, on the other hand, the maximum luminance and the average luminance are controlled by controlling the brightness of a backlight separately from a video signal (that is, by controlling the maximum luminance and the average luminance by two parameters of the video signal and the backlight).

In addition, a case where a display is mounted in a portable device operating using a battery as a power source needs to be taken into consideration for this luminance control. The portable device in this case includes not only devices providing display as a main function but also devices combined with an information processing function and a communicating function.

The portable device is desired to have a mode of changing display luminance according to the brightness of the ambience and a power saving mode intended for use for a long period of time.

Further, the portable device is desired to have provisions for both a high-luminance mode assuming outdoor use and a low luminance mode to be seen naturally even when used in the dark.

SUMMARY OF THE INVENTION

As described above, the luminance control of the recent displays is desired to include not only basic controlling techniques but also various controlling techniques.

In order to make provisions for these controlling techniques, a few controlling techniques have been proposed also for an active matrix type organic EL display. For example, a method of controlling the dynamic range of an input signal has been proposed.

However, the method of controlling the dynamic range of an input signal has problems of an increase in amplitude of an analog signal output from a driving circuit due to an increase in signal amplitude of the input signal and an increase in power consumed in the driving circuit.

A method of reducing power consumption by controlling emission time length (for example Japanese Patent Laid-Open No. 2003-228331) has been proposed, but has a problem of display characteristics being varied according to the emission time length.

To solve the above problem, there is provided, in accordance with an embodiment of the present invention, an emissive type display device including:

- a pixel array section having pixels ready for an active matrix driving system;
- a circuit for setting a peak luminance level of each display frame; and
- a driving circuit for variably controlling a total application period length of a driving voltage applied to a power supply line connected to each pixel and amplitude of the driving voltage so as to obtain a set peak luminance level, when the set peak luminance level is lower than a set value, the driving circuit dividing the driving voltage into a plurality of times of pulse waveform, and variably controlling the amplitude of the driving voltage at each output time according to the peak luminance level such that the amplitude of the driving voltage at least one output time is lower than a maximum driving voltage in a non-emission period.

In accordance with another embodiment of the present invention, there is provided a semiconductor device including:

- a driving circuit for, in variably controlling a total application period length of a driving voltage applied to a power supply line connected to each pixel forming a pixel array section and amplitude of the driving voltage so as to obtain a set peak luminance level, when the set peak luminance level is lower than a set value, dividing the driving voltage into a plurality of times of pulse waveform, and variably controlling the amplitude of the driving voltage at each output time according to the peak luminance level such that the amplitude of the driving voltage at least one output time is lower than a maximum driving voltage in a non-emission period.

In accordance with a further embodiment of the present invention, there is provided, an electronic device including:

- a pixel array section having pixels ready for an active matrix driving system;
- a first driving circuit for driving a signal line;
- a second driving circuit for controlling an operation of writing a potential of the signal line to each pixel forming the pixel array section;
- a circuit for setting a peak luminance level of each display frame;
- a third driving circuit for variably controlling a total application period length of a driving voltage applied to a power supply line connected to each pixel and amplitude of the driving voltage so as to obtain a set peak luminance level, when the set peak luminance level is lower than a set value, the third driving circuit dividing the driving voltage into a plurality of times of pulse waveform, and variably controlling the amplitude of the driving voltage at each output time according to the peak luminance level such that the amplitude of the driving voltage at least one output time is lower than a maximum driving voltage in a non-emission period;

a system controlling section configured to control operation of an entire system; and an operating input section configured to receive an operating input to the system controlling section.

In accordance with a still further embodiment of the present invention, there is provided, a method of driving a power supply line disposed in an emissive type display device, the method including the steps of:

in variably controlling a total application period length of a driving voltage applied to a power supply line connected to each pixel forming a pixel array section and amplitude of the driving voltage so as to obtain a set peak luminance level, dividing the driving voltage into a plurality of times of pulse waveform when the set peak luminance level is lower than a set value; and variably controlling the amplitude of the driving voltage at each output time according to the peak luminance level such that the amplitude of the driving voltage at least one output time is lower than a maximum driving voltage in a non-emission period.

That is, a driving technique combining a pulse driving technique and a driving voltage amplitude varying technique is adopted.

In the case of a driving system according to the embodiment of the present invention, a driving voltage is divided into a plurality of times of pulse waveform when a set peak luminance level is lower than a set value. Thus, the driving system according to the embodiment of the present invention can disperse the output of the driving voltage when a same peak luminance level is achieved over a wider range than an existing system. It is therefore possible to increase an apparent blinking frequency within an emission period, and suppress the occurrence of flicker.

In addition, the peak luminance level is controlled by controlling the driving voltage amplitude of the pulse waveform rather than the output width of the plurality of times of pulse waveform. This system makes it possible to variably control the peak luminance level in a low range while maintaining display quality. Thus, the peak luminance level can be adjusted at lower luminance than in the existing system. Even when the ambience of the display panel is dark, this function enables the peak luminance level to be lowered according to the darkness. Power consumption can be lowered at the same time.

In addition, controllable peak luminance level can be made lower than in the existing system, and therefore the range of variable peak luminance level can be extended as compared with the existing system. That is, a contrast ratio can be extended, and display quality can be enhanced.

BRIEF DESCRIPTION OF THE DRAWINGS

FIGS. 13A, 13B, 13C, 13D, 13E, and 13F are diagrams showing relation of timing of output of driving voltages and the amplitude of the driving voltages;

FIG. 31 is a diagram showing an example of structure of motion quantity data;

FIG. 32 is a diagram showing an example of a table in which correspondences between a motion quantity and a motion value are recorded;

FIG. 37 is a diagram showing an example of a table of correspondences between a luminance level and a luminance level value;

FIG. 40 is a diagram showing an example of a table of correspondences between a frame rate and a frame rate value;

FIG. 41 is a diagram showing an example of a table of correspondences between the area of a high-luminance region and an area value;

FIG. 42 is a diagram showing an example of a table of correspondences between the emission time of a detected high-luminance region and an emission time value;

FIG. 43 is a diagram showing an example of a table of correspondences between flicker information and a driving mode;

DETAILED DESCRIPTION OF THE PREFERRED EMBODIMENTS

Embodiments of the invention will hereinafter be described in the following order.

(A) External Structure of Organic EL Panel Module
(B) First Embodiment
(B-1) System Configuration
(B-2) Configuration of Each Device
(B-3) Example of Driving Operation of Organic EL Panel Module
(B-4) Summary
(C) Second Embodiment
(C-1) System Configuration
(C-2) Configuration of Driving Timing Generating Section
(C-3) Summary
(D) Other Embodiments Incidentally, organic EL panels of an active matrix driving type to be described later are an example of an emissive type display device according to the invention, and it is needless to say that the invention proposed by the inventor et al. is not limited to these embodiments. In addition, well known or publicly known techniques in a pertinent technical field are applied to parts not specifically shown or described in the present specification.

(A) External Structure of Organic EL Panel Module

An example of an external appearance of an organic EL panel module will first be described. In the present specification, not only a panel module in which a pixel array section and a driving circuit are formed by a same process but also a module in which a driving circuit configured as an integrated circuit is mounted on a panel where a pixel array section is formed will be referred to as a panel module. The integrated circuit in this case corresponds to a "semiconductor device" in claims.

Figure 1:
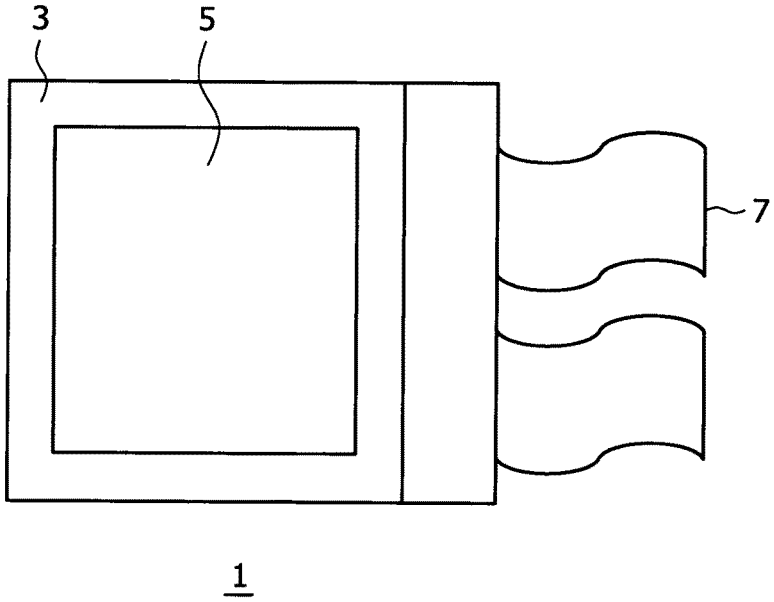
FIG. 1 is a diagram showing an example of an external appearance of an organic EL panel module.

FIG. 1 shows an example of an external appearance of an organic EL panel module. The organic EL panel module 1 has a structure formed by laminating a counter substrate 5 to a supporting substrate 3.

The supporting substrate 3 is formed by a base material such as glass, plastic or the like. The counter substrate 5 also has a transparent member such as glass, plastic or the like as a base material. The counter substrate 5 is a member sealing the surface of the supporting substrate 3 with a sealing material interposed between the counter substrate 5 and the supporting substrate 3.

Incidentally, it suffices to secure the transparency of the substrate only on a light emitting side, and another substrate side may be an opaque substrate.

The organic EL panel module 1 also has an FPC (flexible printed circuit) 7 disposed therein for inputting an external signal and driving power as required.

(B) First Embodiment

In the present embodiment, description will be made of a driving system suitable for a case where an organic EL panel module is mounted in a device having a low display frame rate and strongly desired to lower power consumption.

For example, the driving system is suitable for receiving a one-segment broadcast of a terrestrial digital broadcasting standard adopted in Japan. Of course, the invention itself is not limited to display of one-segment broadcast programs.

Incidentally, in the case of the one-segment broadcast, effective image resolution is given as horizontal 320 dots× vertical 240 dots or horizontal 320 dots×vertical 180 dots.

The display frame rate is given as 15 frames per second, for example. When the display frame rate is thus low, flicker tends to be visible. Accordingly, in the present embodiment, description will be made of a driving system that can lower power consumption while suppressing the occurrence of flicker.

(B-1) Example of System Configuration

Description will first be made of a system configuration of an organic EL panel module 11 that adopts the driving system according to the present embodiment.

Figure 2:
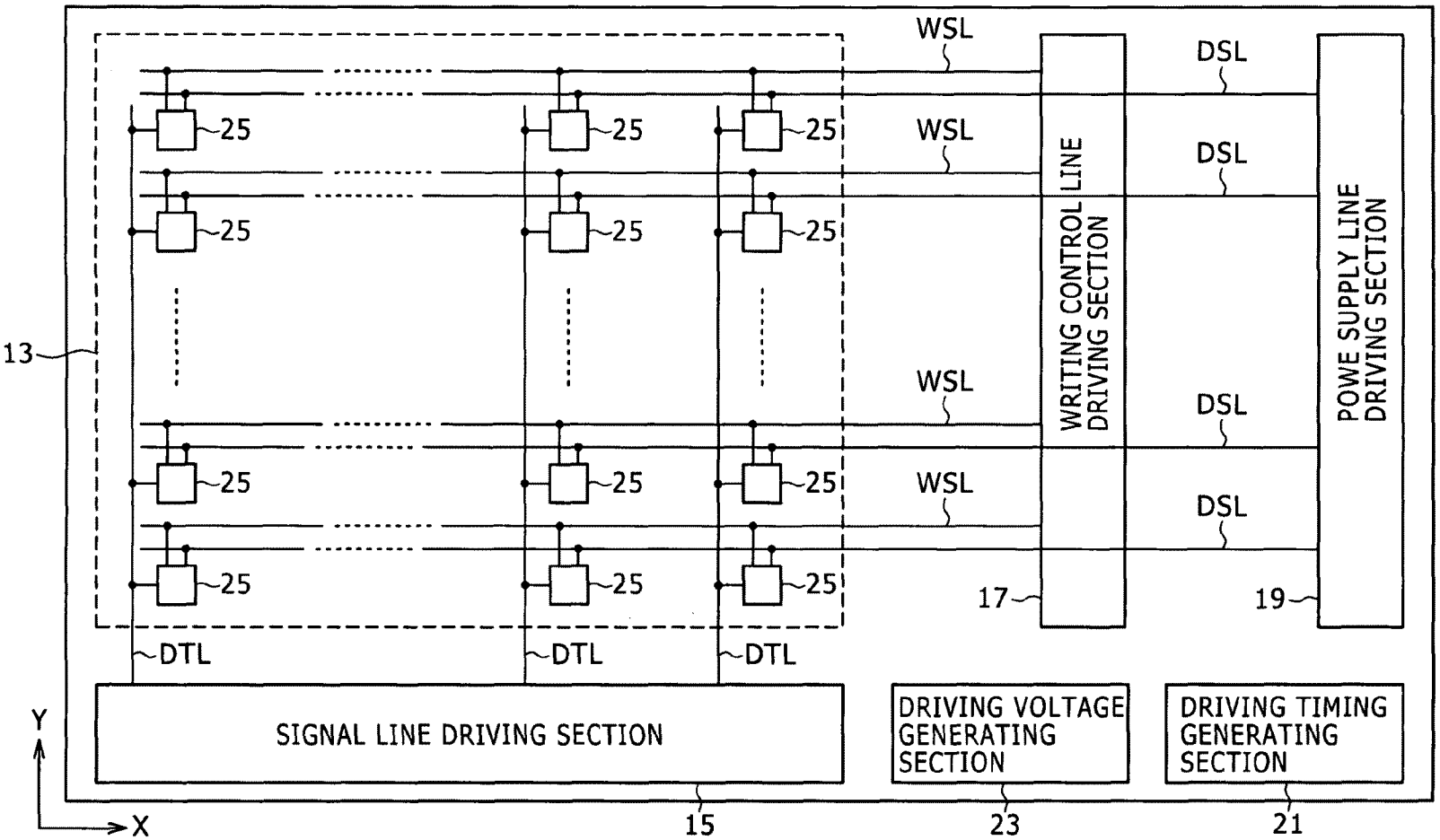
FIG. 2 is a diagram showing an example of configuration of the organic EL panel module.

FIG. 2 shows an example of the system configuration of the organic. EL panel module 11 according to the present embodiment.

The organic EL panel module 11 shown in FIG. 2 has a configuration formed by arranging a pixel array section 13, a signal line driving section 15, a writing control line driving section 17, a power supply line driving section 19, a driving timing generating section 21, and a driving voltage generating section 23 on a single panel.

(B-2) Configuration of Each Device

Embodiments of devices (functional blocks) forming the organic EL panel module 11 will be described in order in the following.

(a) Pixel Array Section

This pixel array section 13 has a pixel structure and a wiring structure enabling an active matrix driving system.

Suppose in the present embodiment that white units forming one pixel for display are arranged in M rows×N columns in the pixel array section 13.

Incidentally, in the present specification, a row refers to a pixel row formed by 3×N sub-pixels 25 extending in an X-direction in FIG. 2. A column refers to a pixel column formed by M sub-pixels 25 extending in a Y-direction in FIG. 2. Of course, the values of M and N are determined according to a display resolution in the vertical direction and a display resolution in the horizontal direction.

Figure 3:
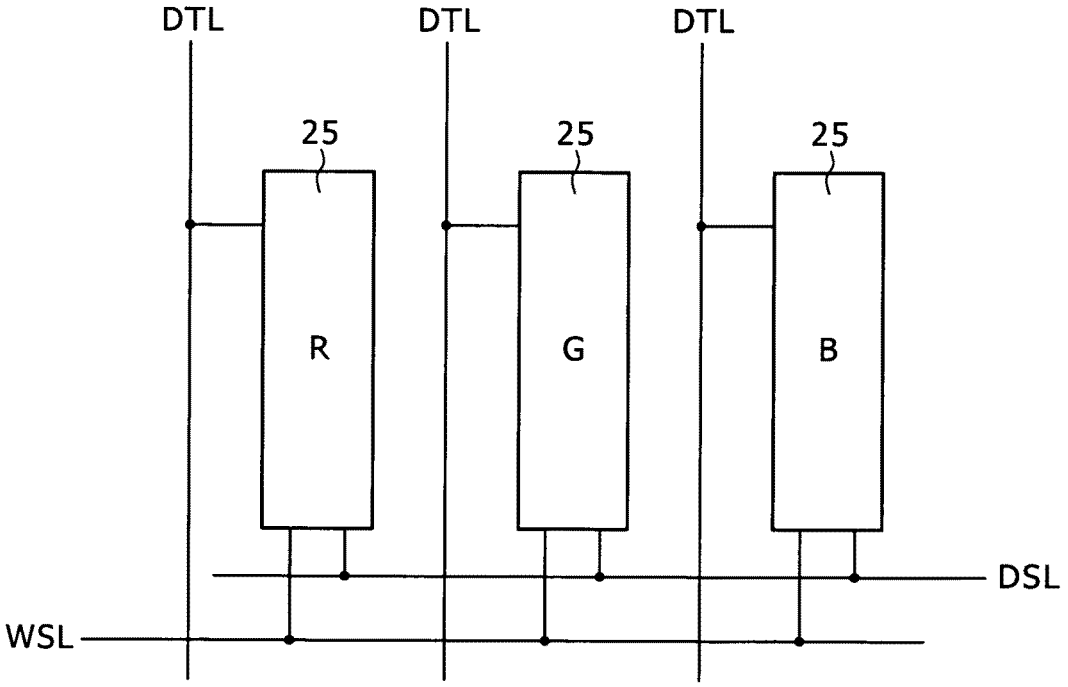
FIG. 3 is a diagram of assistance in explaining an arrangement structure of sub-pixels forming a pixel array section.

FIG. 3 shows an example of arrangement of sub-pixels 25 forming a white unit. FIG. 3 shows an example in which sub-pixels 25 corresponding to an R pixel, a G pixel, and a B pixel corresponding to three primary colors form a white unit. Of course, the configuration of the white unit is not limited to this. In addition, the sub-pixels 25 may have sub-pixel structures of not only a primary color light emission type but also a color conversion type with a filter, a multi-light emission type, and the like.

Figure 4:
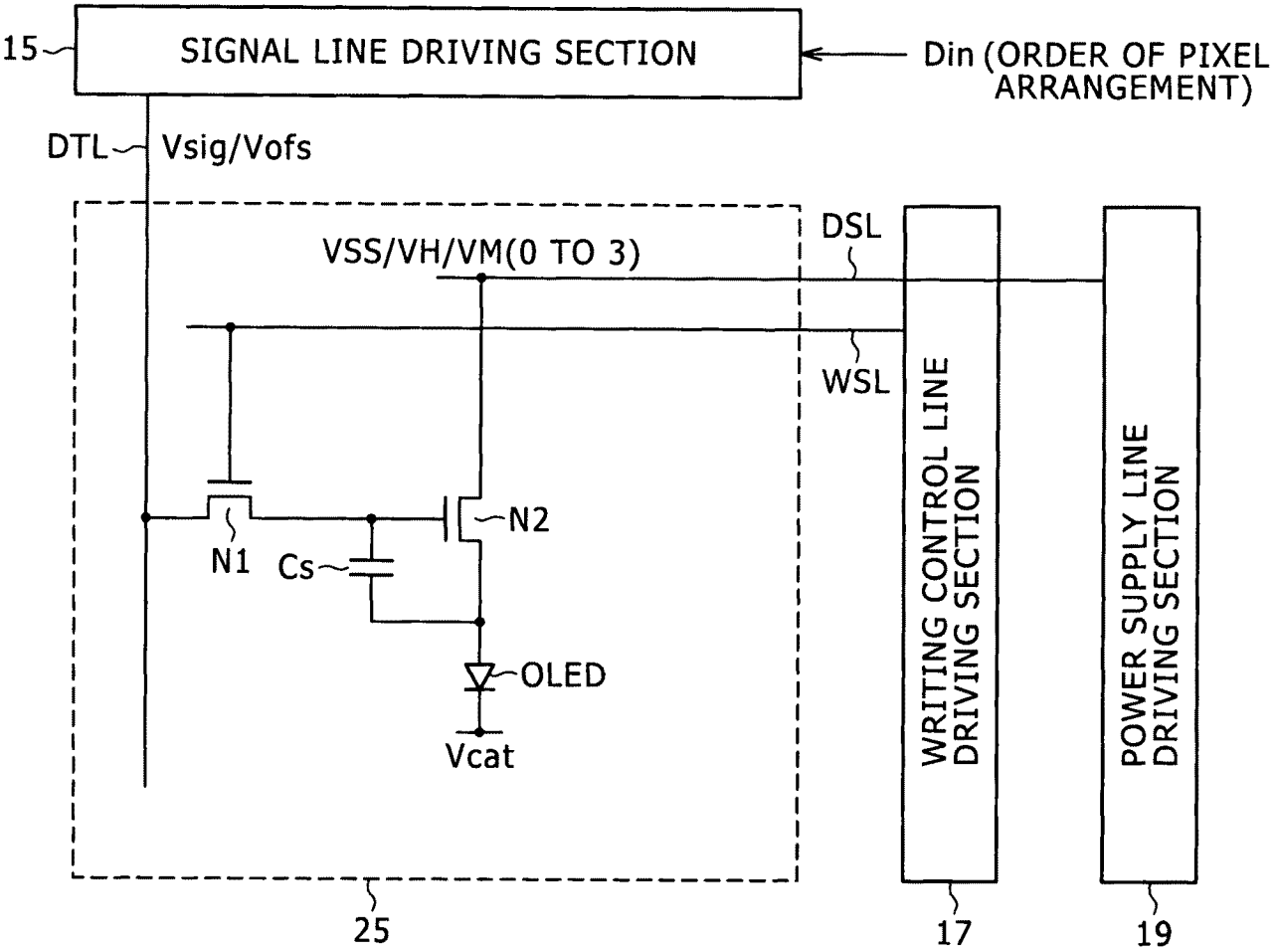
FIG. 4 is a diagram showing an example of circuit configuration of a sub-pixel.

FIG. 4 shows an example of a pixel circuit of a sub-pixel 25 enabling active matrix driving.

Incidentally, a wide variety of circuit configurations have been proposed for this kind of pixel circuit. FIG. 4 shows one of simplest circuit configurations of the various circuit configurations.

Returning to description of the pixel circuit shown in FIG. 4, the pixel circuit shown in FIG. 4 includes two thin film transistors N1 and N2, a storage capacitor Cs, and an organic EL element OLED.

Of these components, the thin film transistor N1 controls timing of sampling a potential appearing in a signal line DTL to the inside of the sub-pixel. This thin film transistor N1 will hereinafter be referred to as a "sampling transistor."

On the other hand, the thin film transistor N2 controls an amount of driving current supplied to the organic EL element OLED. This thin film transistor N2 will hereinafter be referred to as a "driving transistor."

In the case of FIG. 4, the sampling transistor N1 has a control electrode connected to a writing control line WSL, one main electrode connected to the signal line DTL, and another main electrode connected to the control electrode of the driving transistor N2. Thus, a potential appearing in the signal line DTL is written to the inside of the sub-pixel while the sampling transistor N1 is performing an on operation.

On the other hand, the driving transistor N2 has one main electrode connected to a power supply line DSL, and another main electrode connected to the anode electrode of the organic EL element OLED. The control electrode of the driving transistor N2 is connected to the one main electrode of the sampling transistor N1, and is also connected to one electrode of the storage capacitor Cs.

Incidentally, another electrode of the storage capacitor Cs is connected to the anode electrode side of the organic EL element OLED. Thus, the storage capacitor Cs is connected between the control electrode of the driving transistor N2 and the anode electrode side of the organic EL element OLED.

The storage capacitor Cs retains a potential for correcting a variation in characteristic of the driving transistor N2 and a potential corresponding to a pixel gradation for an emission period.

Thus, the driving transistor N2 operates to pass a driving current corresponding to a voltage retained by the storage capacitor Cs through the organic EL element OLED on a condition that a driving voltage (voltage that can perform an on operation on the organic EL element OLED) be applied to the power supply line DSL.

Incidentally, the larger the driving current, the larger the amount of the current flowing through the organic EL element OLED, and the higher the light emission luminance. That is, a pixel gradation is expressed by the magnitude of the driving current. As long as this driving current is supplied, the organic EL element OLED can continue a state of emitting light at a predetermined luminance.

Description will be returned to the general configuration of the pixel array section 13. In the present embodiment, signal lines DTL are arranged in column units. Thus, a potential Vofs for characteristic correction (which potential will hereinafter be referred to as an "offset potential") and a signal potential Vsig corresponding to a pixel gradation can be supplied to all sub-pixels 25 situated in a same column.

In the present embodiment, writing control lines WSL and power supply lines DSL are arranged in row units. Thus, each of a writing control pulse and a driving voltage can be supplied to all sub-pixels 25 situated in a same row.

In the present embodiment, the driving voltage corresponding to a display mode is applied to the power supply lines DSL. Though details will be described later, in the present embodiment, four modes, that is, a maximum luminance mode, an intermediate luminance mode, a low luminance mode, and a lowest luminance mode are assumed. Incidentally, in the maximum luminance mode, the peak luminance level of one frame period is fixed at 600 nits. In the intermediate luminance mode, the peak luminance level is variably set between 600 nits and 40 nits.

In the low luminance mode, the peak luminance level is fixed at 40 nits. In the lowest luminance mode, the peak luminance level of one frame period is variably set between 40 nits and a lowest value (a set value higher than 0 nits). An operation of controlling the driving voltage corresponding to the lowest luminance mode corresponds to the driving operation of a "driving circuit" described in claims.

Incidentally, in the intermediate luminance mode, driving voltages VH (fixed), VM (variable), and VSS (fixed) are used to drive the power supply lines DSL. Of these driving voltages, the driving voltage VH corresponds to a maximum driving voltage that can be applied to the power supply lines DSL. The driving voltage VSS is lower than a cathode voltage Vcat, and thus controls the organic EL element OLED in a reverse-biased state. This driving voltage VSS is applied to the power supply lines DSL in a non-emission period.

The driving voltage VM is variably set in an intermediate range between the driving voltage VH and a driving voltage VM0 (>VSS). This driving voltage VM will hereinafter be referred to also as a variable driving voltage. In this case, the driving voltage VM0 giving a lower limit of the variable driving voltage VM can perform quenching control on the organic EL element OLED. However, the driving voltage VM0 is set in such a range as not to apply a reverse bias to the organic EL element OLED. The driving voltage VM0 is for example set at the cathode potential Vcat of the organic EL element OLED.

In this case, the cathode potential Vcat (that is, the driving voltage VM0) is used for quenching control on the organic EL element OLED in an emission period in order to prevent application of a reverse bias voltage to the organic EL element OLED. Generally, repeating a forward bias voltage and a reverse bias voltage imposes a heavy load on the panel including the organic EL element OLED. Accordingly, in the present embodiment, the cathode potential Vcat (that is, VM0) is adopted as minimum value of the variable driving voltage VM to minimize the load put on the panel.

In addition, in the lowest luminance mode, a maximum of four values of driving voltages VM0 to VM3 are used in addition to the driving voltages VH (fixed) and VSS (fixed).

Of these driving voltages, the driving voltage VM0 corresponds to the cathode potential Vcat of the organic EL element OLED, as described above.

The other driving voltages VM1 to VM3 are variably set for different times of output of the driving voltages applied in the form of a pulse according to a set peak luminance level. These driving voltages VM1 to VM3 also will hereinafter be referred to as variable driving voltages. The three variable driving voltages VM1 to VM3 are assumed because the number of times of output of the variable driving voltage output in the form of a pulse is three in the present embodiment. Thus, the number of driving voltages prepared is increased or decreased according to the assumed number of times of output.

Incidentally, a minimum value is provided for these driving voltages VM1 to VM3. In the present specification, a driving voltage giving the minimum value is set as a driving voltage VM1 (min), which is higher than the driving voltage VM0. This minimum value defines a minimum value of the settable peak luminance level. Thus, the variable driving voltages VM1 to VM3 are varied in an intermediate range between the driving voltages VH and VM (min). A more concrete method of driving the power supply lines DSL will be described later.

(b) Signal Line Driving Section

The signal line driving section 15 is a circuit device for applying an offset voltage Vofs necessary for correcting the characteristic of the sub-pixels 25 and a signal potential Vsig corresponding to a pixel gradation to the signal lines DTL. The signal lines DTL are arranged in column units, and apply a potential to all sub-pixels 25 situated in a same column.

The signal line driving section 15 in the present embodiment includes a shift register, a latch circuit stage, a digital/analog converter circuit stage, a selector stage, and an output buffer stage. The shift register is formed by a same number of stages of flip-flops as the horizontal resolution. The shift register transfers an output pulse in the horizontal direction (X-direction in FIG. 2) in a line-sequential manner according to a horizontal scanning clock. This output pulse is used as a latch timing signal.

The latch circuit stage is also formed by a same number of stages of latch circuits as the horizontal resolution. Each latch circuit is supplied with the latch timing signal output from a corresponding output stage of the shift register. Each latch circuit stores gradation data at a time of input of the latch timing signal. The digital/analog converter circuit stage is also formed by a same number of stages of digital/analog converter circuits as the horizontal resolution.

The digital/analog converter circuits perform an operation of converting corresponding gradation data into an analog signal (signal potential Vsig).

The selector stage is also formed by a same number of stages of selectors as the horizontal resolution. Each selector selectively outputs one of the signal potential Vsig and the offset voltage Vofs according to driving timing to be described later.

The output buffer stage is also formed by a same number of stages of output buffers as the horizontal resolution. Each output buffer drives the potential of a corresponding individual signal line DTL. The output buffer also performs a level shifting operation.

(c) Writing Control Line Driving Section

The writing control line driving section 17 is a circuit device for applying a control pulse giving timing of writing the offset voltage Vofs and the signal potential Vsig to the writing control lines WSL. In the present embodiment, the writing control lines WSL are arranged in row units, as described above. Thus, the writing control line driving section 17 operates in synchronism with a horizontal synchronizing clock, and operates so as to output a control pulse to the pixel column of a next row each time the horizontal synchronizing clock is input.

The writing control line driving section 17 in the present embodiment is formed by a shift register in which each output stage corresponds to each row (pixel column) and an output buffer stage corresponding to each row. Incidentally, the shift register is for example used to sequentially transfer a timing signal giving timing of a rising edge of the control pulse and timing of a falling edge of the control pulse to a next row.

The output buffer stage includes a logic circuit for generating the control pulse on the basis of a timing pulse supplied from the shift register, a level shifter for converting the control pulse to a potential suitable for driving, and a buffer circuit for actually driving the writing control lines WSL.

(d) Power Supply Line Driving Section

The power supply line driving section 19 is a circuit device for controlling the driving operation of the sub-pixels 25 in such a manner as to be interlocked with the control operation of the writing control lines WSL. As described above, the power supply line driving section 19 applies one of three to six values of driving voltage to the power supply lines DSL temporally sequentially.

Incidentally, in the present specification, a period during which the organic EL element OLED emits light will be referred to as an emission period, and a period during which the organic EL element OLED does not emit light will be referred to as a non-emission period.

Of course, even the emission period includes a period during which the organic EL element OLED is controlled in a quenched state, such as a period during which the driving voltage VM0 (that is, the cathode potential Vcat) is applied. Thus, the emission period in this case will be used to signify a period during which no reverse bias is applied to the organic EL element OLED.

Figure 5:
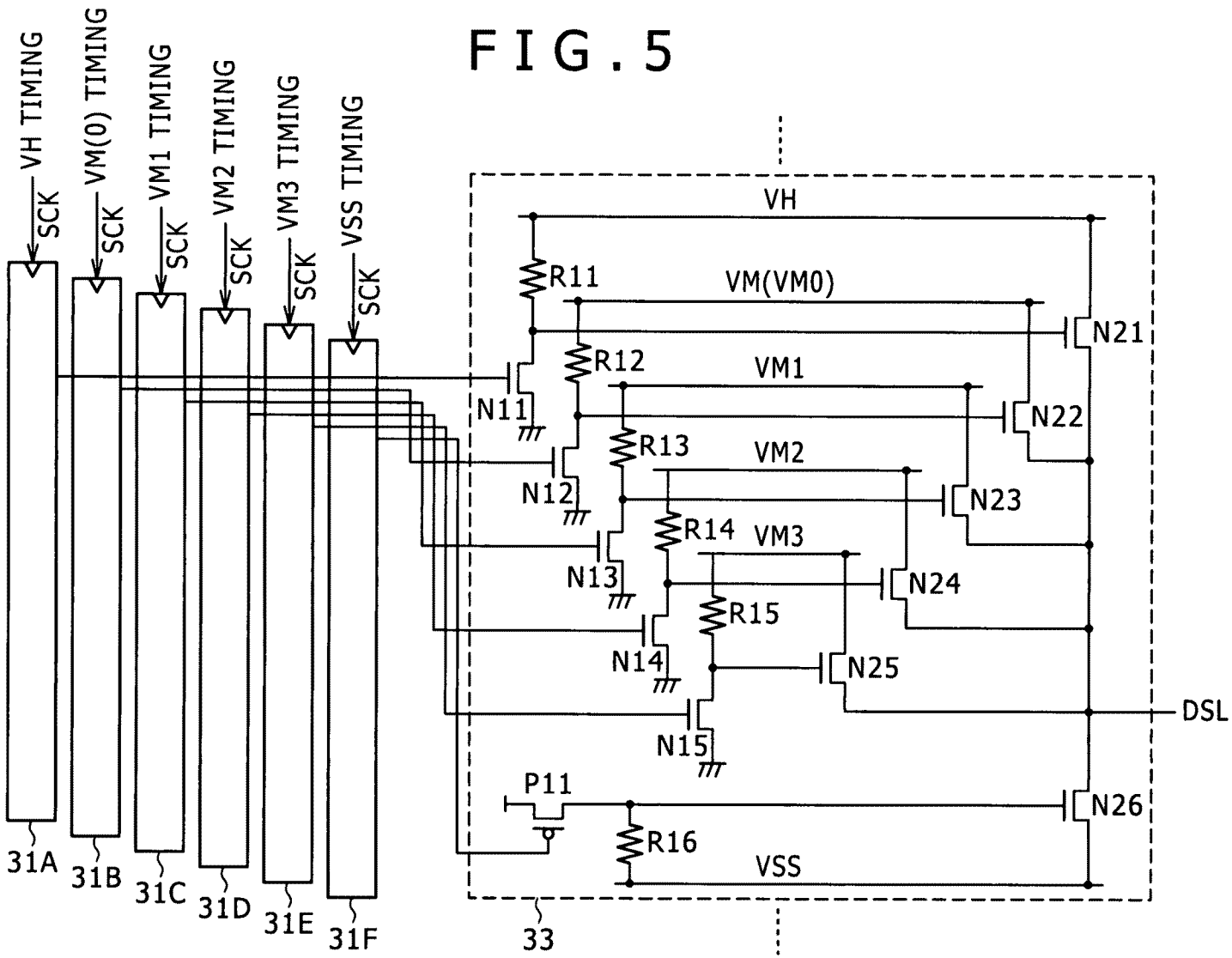
FIG. 5 is a diagram of assistance in explaining an example of configuration of a power supply line driving section.

FIG. 5 shows an example of internal configuration of the power supply line driving section 19. The power supply line driving section 19 includes six stages of shift registers 31A to 31F for transferring an output timing pulse corresponding to each of six values of driving voltage on a line-sequential basis and M output stage circuits 33 corresponding to the individual power supply lines DSL. FIG. 5 shows only one output stage circuit 33 due to a limitation in drawing the figure.

The shift register 31A is for the driving voltage VH. The shift register 31B is for the driving voltage VM. The shift register 31B is also used to control timing of output of the driving voltage VM0 as minimum value in the variable range. The shift register 31C is for the driving voltage VM1. The shift register 31D is for the driving voltage VM2. The shift register 31E is for the driving voltage VM3. The shift register 31F is for the driving voltage VSS.

Each of the shift registers operates in synchronism with a shift clock for advancing a horizontal line to be processed by one row at a time, and operates so as to advance a logical level value retained by each stage to a next stage in timing in which the shift clock is input. Incidentally, a timing pulse corresponding to each shift register is supplied from the driving timing generating section 21.

The output stage circuit 33 includes buffer circuits N21 to N26 corresponding to six internal power supply lines, respectively, and a switching circuit for controlling the operation of each buffer circuit. Incidentally, the switching circuit includes a thin film transistor whose control terminal is supplied with a clock pulse from a shift register and a load resistance. In FIG. 5, a thin film transistor N11 and a load resistance R11 form a switching circuit for the driving voltage VH.

Similarly, a thin film transistor N12 and a load resistance R12 form a switching circuit for the driving voltage VM. A thin film transistor N13 and a load resistance R13 form a switching circuit for the driving voltage VM1. A thin film transistor N14 and a load resistance R14 form a switching circuit for the driving voltage VM2. A thin film transistor N15 and a load resistance R15 form a switching circuit for the driving voltage VM3. A thin film transistor P11 and a load resistance R16 form a switching circuit for the driving voltage VSS.

In this case, the supply of the driving voltage to the power supply line DSL by each buffer circuit is performed exclusively by control of the switching circuit. For example, timing is controlled such that only the thin film transistor N11 performs an on operation and the other thin film transistors N12 to N15 and P11 perform an off operation in timing of output of the driving voltage VH. The output timing pulses for these thin film transistors are set in the driving timing generating section 21 according to a set peak luminance level.

(e) Driving Timing Generating Section

The driving timing generating section 21 is a circuit device for generating the output timing pulses used for the driving of the power supply line driving section 19. Incidentally, of output timings of the six kinds of timing pulses, only output timings of the driving voltage VH and the driving voltage VSS in the non-emission period are set fixedly. The other output timings are generated by the driving timing generating section 21.

Figure 6:
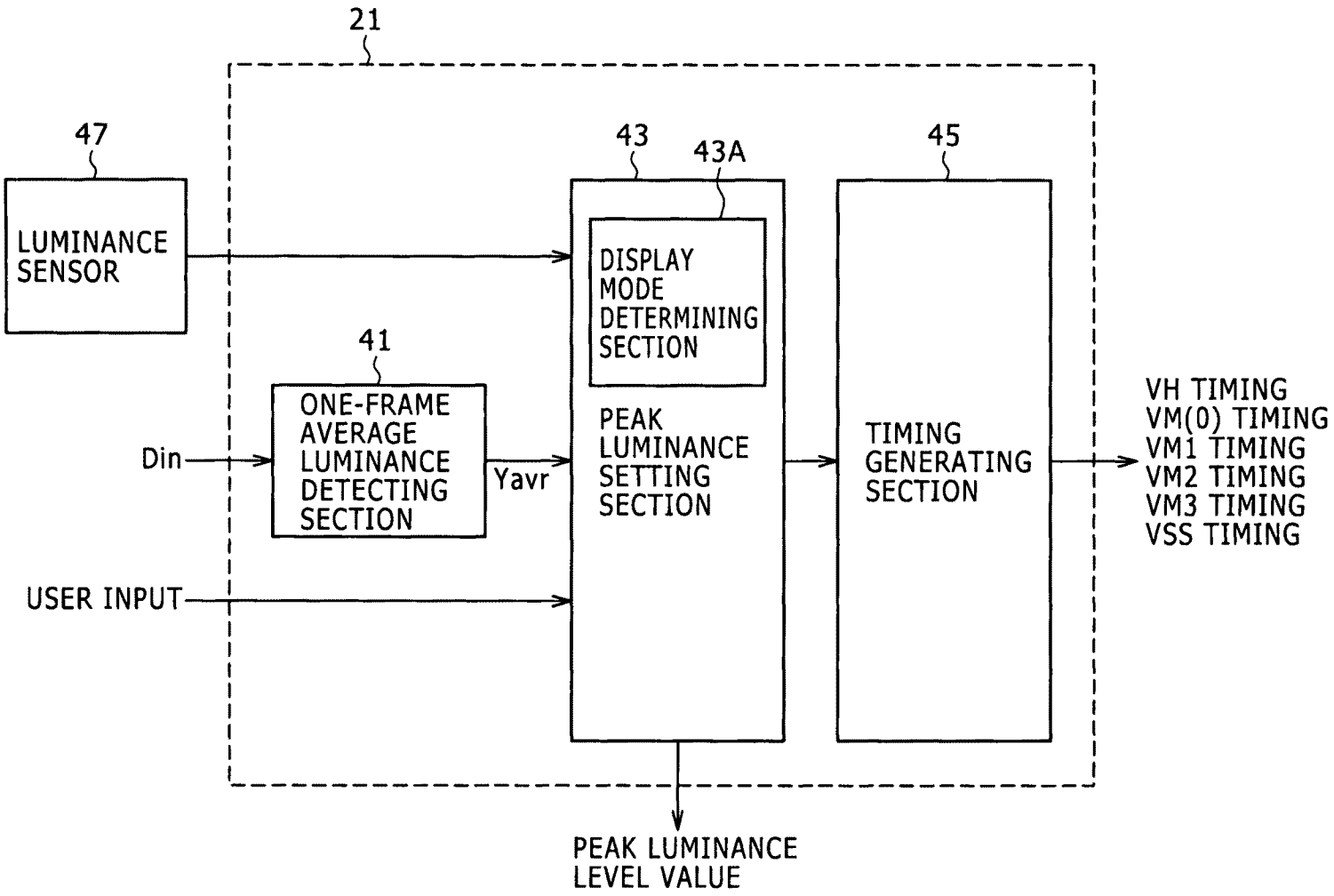
FIG. 6 is a diagram of assistance in explaining an example of circuit configuration of a driving timing generating section.

FIG. 6 shows an example of circuit configuration of the driving timing generating section 21. The driving timing generating section 21 includes a one-frame average luminance detecting section 41, a peak luminance setting section 43, and a timing generating section 45.

Of these components, the one-frame average luminance detecting section 41 is a circuit device for calculating an average luminance level Yavr of input image data Din corresponding to all pixels forming one frame screen.

Incidentally, the input image data Din is given in a data format of R (red) pixel data, G (green) pixel data, and B (blue) pixel data, for example. In the present embodiment, the average luminance level Yavr is calculated as a value with a maximum value of gradation values as 100%.

The one-frame average luminance detecting section 41 adopts a method of first converting the R pixel data, the G pixel data, and the B pixel data corresponding to each pixel into luminance levels in pixel units, and calculating the average luminance level Yavr by a weighting operation on these luminance levels.

Incidentally, the average luminance level Yavr may be calculated in a unit of one frame, or may be calculated as an average value of a unit of a plurality of frames.

In addition, in the present embodiment, the average luminance level Yavr is calculated only when the intermediate luminance mode or the lowest luminance mode is selected as a display mode. Of course, the average luminance level Yavr can be calculated regardless of the display mode.

However, in the maximum luminance mode and the low luminance mode, the peak luminance level is set fixedly regardless of the average luminance level. Thus, power consumption can be reduced by stopping the calculation of the average luminance level Yavr in these display modes.

The peak luminance setting section 43 is a circuit device for determining a display mode on the basis of ambient luminance information input from a luminance sensor 47, user input information, the average luminance level Yavr, program information, and the like, and setting the peak luminance level according to the determined display mode. Incidentally, a movie, a variety show, a drama, news and the like are considered as the program information. Generally, movies often have a dark screen, but a high peak luminance level is desired in consideration of an aspect of contrast.

In the present embodiment, the peak luminance setting section 43 sets the maximum luminance mode when it is determined from the ambient luminance information that the ambience is bright, for example (when it is determined that the ambience is outdoors in fair weather, for example). The peak luminance setting section 43 sets the lowest luminance mode when it is determined from the ambient luminance information that the ambience is dark, for example (when it is determined that the ambience is in a nighttime, for example). Of course, user input and other setting information are considered in these determinations, and the display mode is determined. Incidentally, the intermediate luminance mode is generally selected, and the low luminance mode is selected in a power saving mode or the like.

In fact, various methods have already been proposed as display mode setting methods. Therefore detailed description will be omitted. A display mode determining section 43A in the peak luminance setting section 43 performs a function of setting the display mode. The display mode determining section 43A corresponds to a "determining section" in claims.

The peak luminance setting section 43 sets the peak luminance level according to the thus determined display mode.

Figure 7:
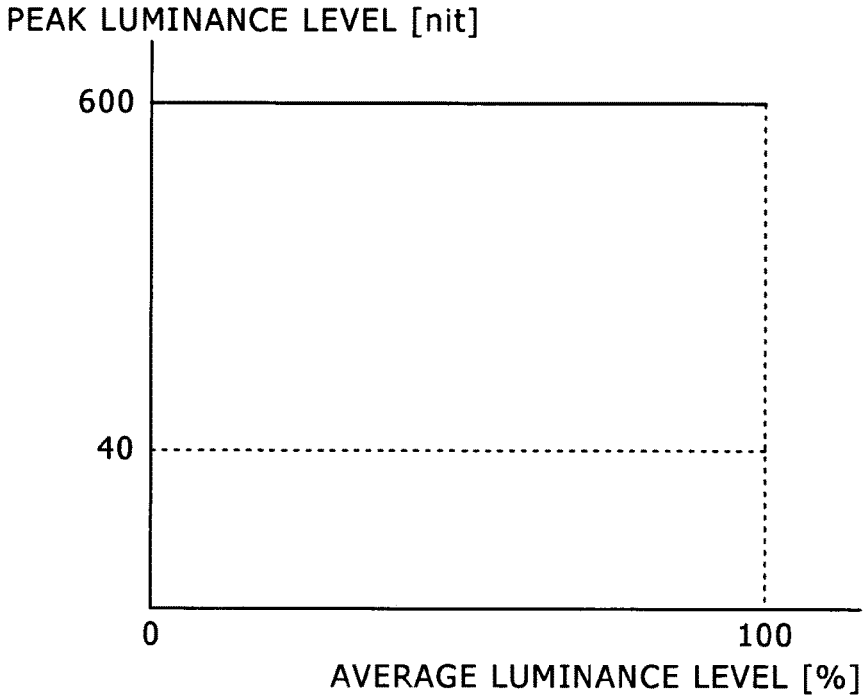
FIG. 7 is a diagram showing relation between peak luminance level and the average luminance level of an input image in a maximum luminance mode.

For example, when the display mode is the maximum luminance mode, the peak luminance setting section 43 sets the peak luminance level at 600 nits. FIG. 7 shows relation between the peak luminance level and the average luminance level Yavr of an input image.

Figure 8:
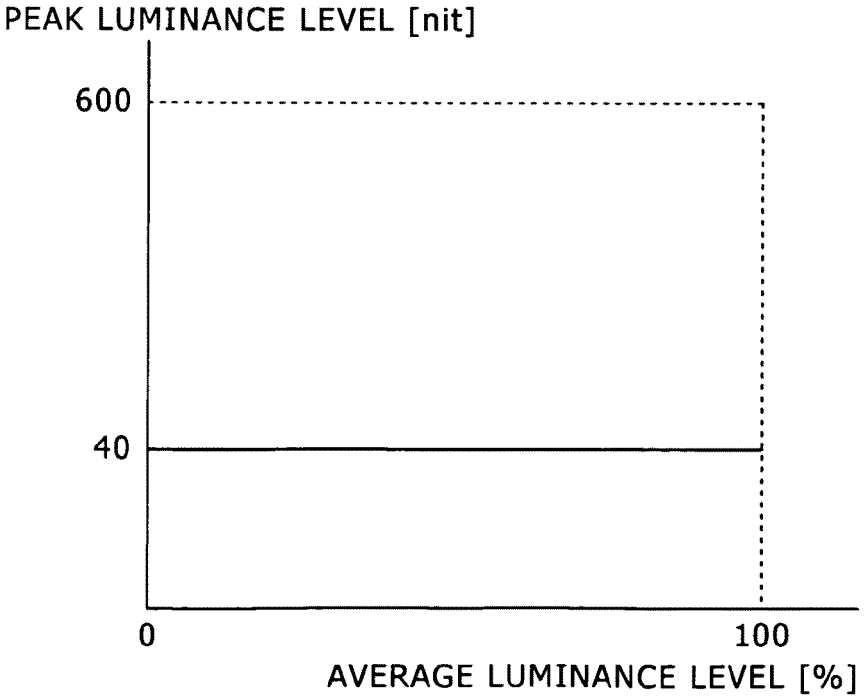
FIG. 8 is a diagram showing relation between peak luminance level and the average luminance level of an input image in a low luminance mode.

For example, when the display mode is the low luminance mode, the peak luminance setting section 43 sets the peak luminance level at 40 nits. FIG. 8 shows relation between the peak luminance level and the average luminance level Yavr of an input image.

Figure 9:
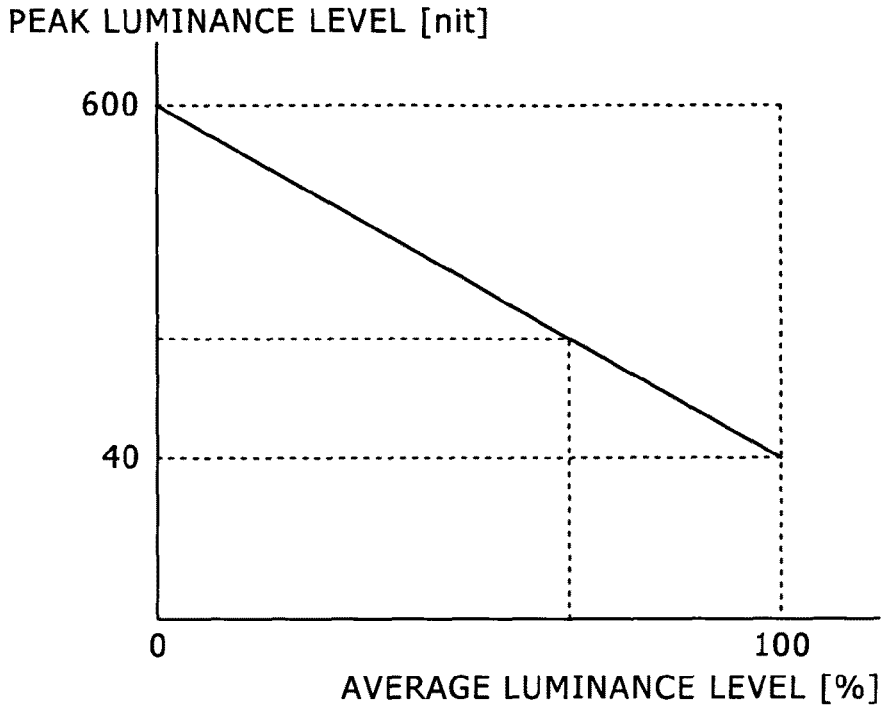
FIG. 9 is a diagram showing relation between peak luminance level and the average luminance level of an input image in an intermediate luminance mode.

For example, when the display mode is the intermediate luminance mode, the peak luminance setting section 43 sets the peak luminance level in a range of 40 nits to 600 nits according to the magnitude of the average luminance level Yavr. FIG. 9 shows relation between the peak luminance level and the average luminance level Yavr of an input image.

As shown in FIG. 9, in the intermediate luminance mode, the peak luminance level is set on the basis of the average luminance level of an input image. Thus, the peak luminance level is set at a high value in the dynamic range for a frame screen having a low average luminance level Yavr. On the other hand, the peak luminance level is set at a low value in the dynamic range for a frame screen having a high average luminance level Yavr.

Such a setting is made because it is necessary to increase a contrast ratio by heightening the luminance of bright dots at a time of display of neon light in a night view or a starlit sky.

Figure 10:
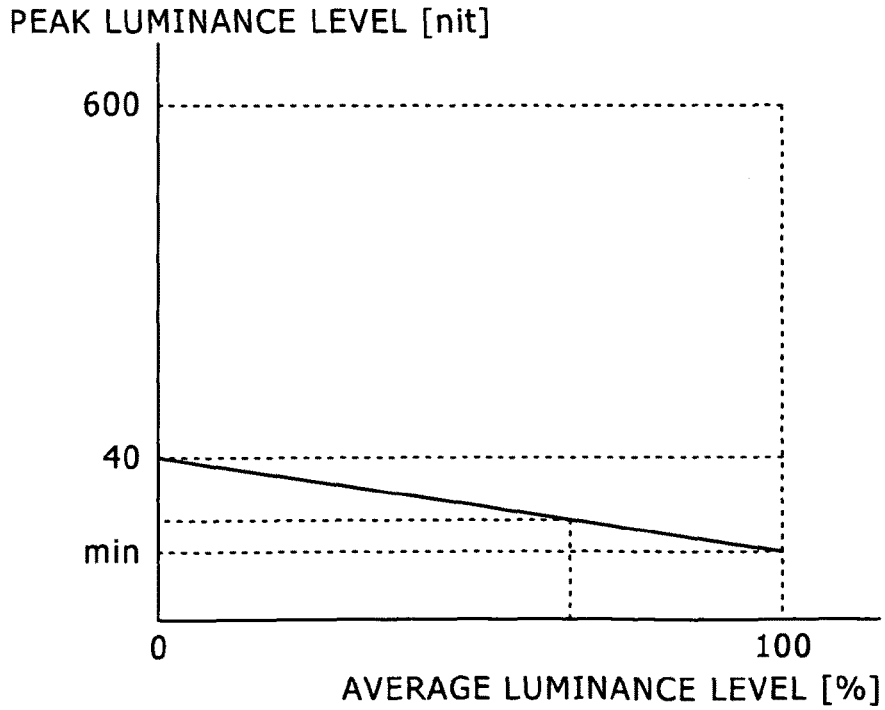
FIG. 10 is a diagram showing relation between peak luminance level and the average luminance level of an input image in a lowest luminance mode.

For example, when the display mode is the lowest luminance mode, the peak luminance setting section 43 sets the peak luminance level in a range of 40 nits and less according to the magnitude of the average luminance level Yavr. Incidentally, a minimum value of the peak luminance level is determined in advance. FIG. 10 shows relation between the peak luminance level and the average luminance level Yavr of an input image.

As in the lowest luminance mode, the peak luminance level is set on the basis of the average luminance level of an input image. Again, the peak luminance level is set at a high value in the dynamic range for a frame screen having a low average luminance level Yavr. On the other hand, the peak luminance level is set at a low value in the dynamic range for a frame screen having a high average luminance level Yavr.

Figure 11:
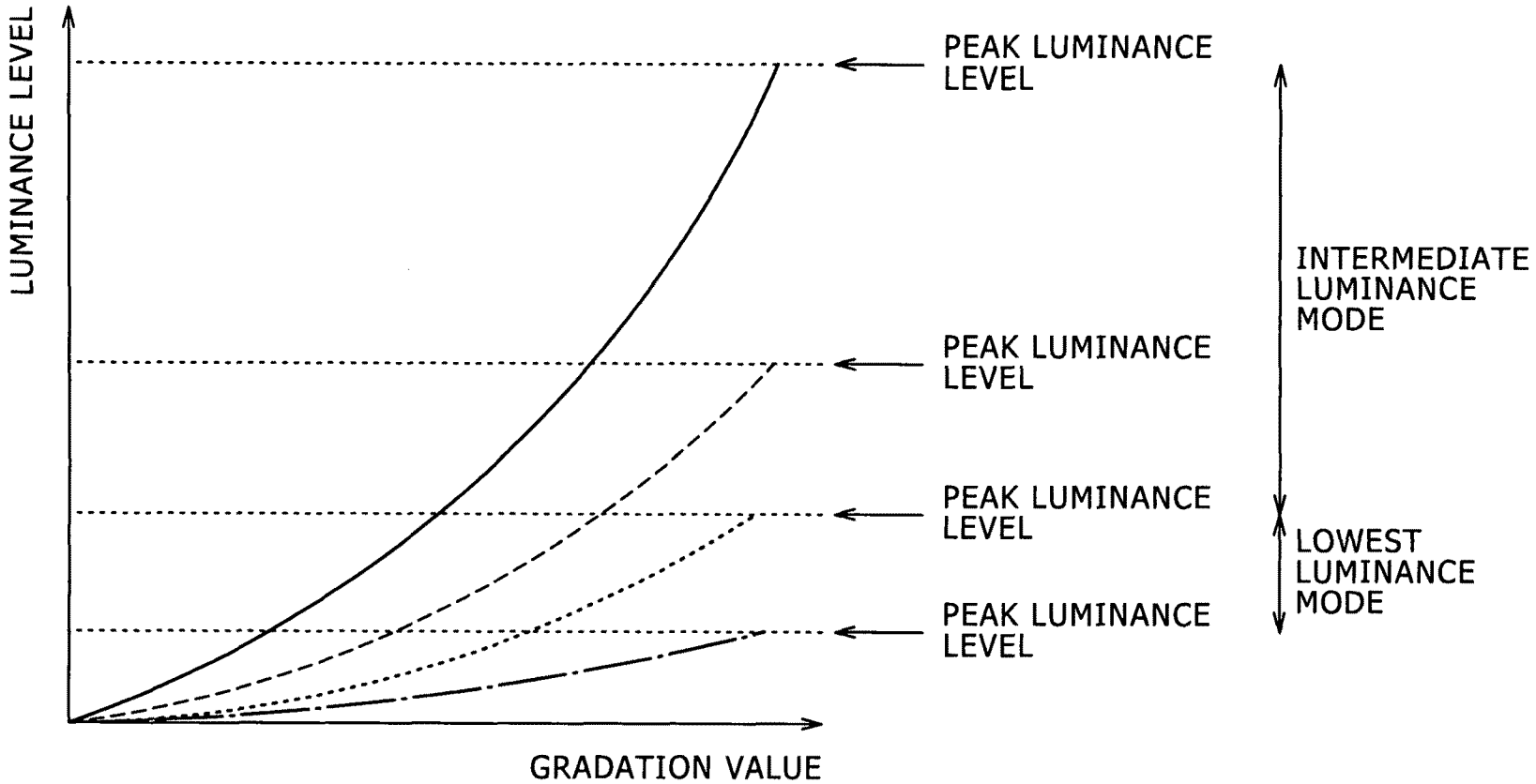
FIG. 11 is a diagram showing relation between peak luminance level and change in luminance level according to a pixel gradation value.

FIG. 11 shows relation between the peak luminance level and change in luminance level according to a pixel gradation value. As shown in FIG. 11, in the intermediate luminance mode, the peak luminance level is variably controlled over a wide range according to the average luminance level Yavr. Incidentally, FIG. 11 also shows a variable range of the peak luminance level in the lowest luminance mode to be described next. Incidentally, gradation luminance changes along a solid line in FIG. 11 in the maximum luminance mode. Gradation luminance changes along a dotted line in FIG. 11 in the low luminance mode.

Figures 12A, 12B, 12C:
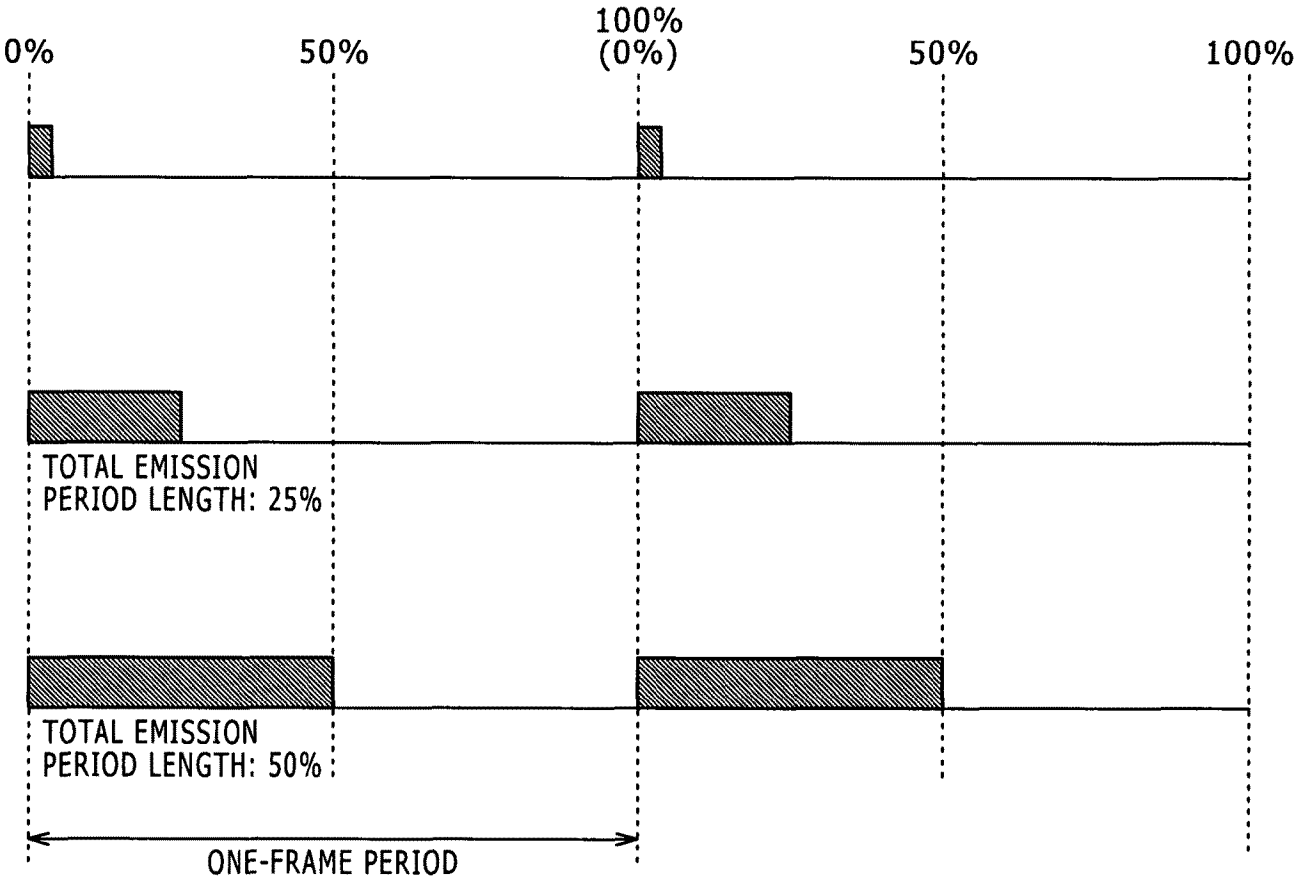
FIGS. 12A, 12B, and 12C are diagrams showing an image of length control of a total emission period length.

The timing generating section 45 is a circuit device for determining timing of output of a maximum of six values of driving voltage so as to obtain the set peak luminance level. As described above, the peak luminance level is variably controlled by a combination of a total emission period length within one frame and the amplitude of the driving voltage. FIGS. 12A, 12B, and 12C show an image of length control of the total emission period length. When the amplitude of the driving voltage is the same, the longer the total emission period length occupied within one frame (that is, the length of a period of application of the driving voltage having a sufficient magnitude to make the organic EL element OLED emit light), the higher the peak luminance level.

However, the driving voltage having the sufficient magnitude to make the organic EL element OLED emit light does not necessarily need to be applied continuously as shown in FIGS. 12A, 12B, and 12C, but may be divided and output a plurality of times in a dispersed manner within one frame period. When the output of the driving voltage having the sufficient magnitude to make the organic EL element OLED emit light is divided into a plurality of times, the peak luminance level is determined by a sum total of period lengths of the application for the respective times of the output (that is, the total emission period length).

Incidentally, when the application period length of the total emission period length is the same, the peak luminance level achieved is the same, but a luminance distribution within one frame period differs between the time of the continuous output and the time of the dispersed output.

When the driving voltage having the sufficient magnitude to make the organic EL element OLED emit light is arranged at equal intervals within one frame period, in particular, an apparent blinking frequency is increased, and thus flicker is perceived less easily. In addition, in a case where the application of the driving voltage having the sufficient magnitude to make the organic EL element OLED emit light is divided into a plurality of times, the occurrence of a moving image blur can be reduced by setting an application period length for a particular output time longer than those of output times occurring on both sides of the particular output time, for example.

These differences in visibility are realized by differences in luminance distribution. That is, the dispersion of the luminance distribution is effective in reducing flicker, while the concentration of the luminance distribution is effective in reducing a moving image blur.

FIGS. 13A, 13B, 13C, 13D, 13E, and 13F show relation of timing of output of the driving voltages adopted in the present embodiment and the amplitude of the driving voltages.

FIG. 13A shows a frame pulse giving one frame period. In the present embodiment, a one-segment broadcast program is assumed for a display image, and therefore the number of horizontal lines forming one screen is 240.

FIG. 13B shows a pattern of output of the driving voltages used in the maximum luminance mode. In the case of the maximum luminance mode, 98% of one frame period (for 236 lines of the horizontal lines) is a period of output of the driving voltage VH, and 2% of one frame period (for four lines of the horizontal lines) is a period of output of the driving voltage VSS.

That is, the timing generating section 45 generates a VH timing pulse so as to make the driving voltage VH output for the period of the 236 lines of one frame period from a falling edge of the frame pulse. In addition, the timing generating section 45 generates a VSS timing pulse so as to make the driving voltage VSS output for the period of the four lines from a point in time that the period of the 236 lines of one frame period has passed after the falling edge of the frame pulse.

Incidentally, the period of output of the driving voltage VSS is the non-emission period that always needs to be disposed within one frame. An operation of initializing a potential state retained by the sub-pixels 25 and a threshold value correction preparatory operation are performed in the non-emission period. This period of output of the driving voltage VSS is common to all the display modes.

In addition, in the figures, during the period of application of the driving voltage VH immediately after the falling edge of the frame pulse, correction of variation in characteristic of the driving transistor N2 (threshold value correction and mobility correction) and an operation of writing signal potential Vsig are performed.

These operations need the application of the driving voltage VH to the power supply lines DSL. Thus, in any of the display modes to be described later, the period of output of the driving voltage VH having a waveform shaped in the form of a pulse is disposed immediately after the falling edge of the frame pulse.

FIG. 13C shows a pattern of output of the driving voltages used in the intermediate luminance mode. In this intermediate luminance mode, four periods of output of the driving voltage VH are set at equal intervals from the timing of the falling edge of the frame pulse. A pulse output width in this case is set as a fixed width of a unit of a few lines. Incidentally, the pulse output period (period of output of the driving voltage VH) situated in the front in the figures among the four pulse output periods is used to perform mobility correcting operation and the like in the non-emission period, as described above.

Thus, the number of output pulses output during the emission period is three. Therefore, even when the display frame rate is 15 frames per second, the apparent blinking frequency can be increased to 45 frames per second, which is three times the display frame rate of 15 frames per second. An apparent frame rate of 45 frames per second can reduce flicker. Of course, four output pulses within the emission period can increase the apparent frame rate to 60 frames per second. In this case, flicker can be further reduced. Thus, it is desirable to set the number of times of pulse output according to the display frame rate.

The four pulse output periods are fixed output periods of the driving voltage VH, and are unchanged regardless of the magnitude of the intermediate voltage (that is, the variable driving voltage VM). Incidentally, the magnitude of the intermediate voltage is generated in the driving voltage generating section 23 to be described later. The minimum value of the driving voltage VM in this case is the driving voltage VM0, and the maximum voltage of the driving voltage VM is the driving voltage VH.

The timing generating section 45 generates a VM timing pulse so as to output the variable driving voltage VM for periods excluding the four pulse output periods set fixedly in the period of the 236 lines from the falling edge of the frame pulse. That is, in the case of FIG. 13C, the timing generating section 45 generates three timing pulses, that is, the VH timing pulse, the VM timing pulse, and the VSS timing pulse.

FIG. 13D shows a pattern of output of the driving voltages used in the low luminance mode. This output pattern is the same as the output pattern of the intermediate luminance mode. Only driving voltage amplitude is different. Thus, the timing generating section 45 generates the VH timing pulse for the four pulse output periods as the fixed output periods of the driving voltage VH. Then, the timing generating section 45 generates a VM0 timing pulse so as to output the driving voltage VM0 for periods excluding the four pulse output periods set fixedly in the period of the 236 lines from the falling edge of the frame pulse. That is, in the case of FIG. 13D, the timing generating section 45 generates three timing pulses, that is, the VH timing pulse, the VM0 timing pulse, and the VSS timing pulse.

FIG. 13E shows an ordinary pattern of output of the driving voltages used in the lowest luminance mode. In this lowest luminance mode, the amplitude of the driving voltages of the pulse output periods appearing as a second pulse output period and subsequent pulse output periods from the front among the four pulse output periods is variably controlled so that the peak luminance level of the low luminance mode is a maximum value. Specifically, the driving voltage amplitude is controlled so as to be decreased as an output time advances.

In the present embodiment, the amplitude of the driving voltage of the pulse output period appearing as fourth pulse output period from the front is set as VM1, and a pulse giving timing of output of the driving voltage will be referred to as a VM1 timing pulse.

The amplitude of the driving voltage of the pulse output period appearing as third pulse output period from the front is set as VM2, and a pulse giving timing of output of the driving voltage will be referred to as a VM2 timing pulse. The amplitude of the driving voltage of the pulse output period appearing as second pulse output period from the front is set as VM3, and a pulse giving timing of output of the driving voltage will be referred to as a VM3 timing pulse.

That is, in the case of FIG. 13E, the timing generating section 45 generates six timing pulses, that is, the VH timing pulse, the VM0 to VM3 timing pulses, and the VSS timing pulse.

Incidentally, FIG. 13F corresponds to an output pattern for realizing the minimum value of the peak luminance level among output patterns used in the lowest luminance mode. In the case of FIG. 13F, the driving voltage amplitudes of the pulse output periods appearing as second pulse output period and subsequent pulse output periods from the front among the four pulse output periods are set at a same minimum value VM1 (min). In this case, the timing generating section 45 generates three timing pulses, that is, the VH timing pulse, the VM1 (min) timing pulse, and the VSS timing pulse.

(f) Driving Voltage Generating Section 23

The driving voltage generating section 23 is a circuit device for generating the driving voltages used for the driving of the power supply line driving section 19 according to the peak luminance level corresponding to a display mode.

Figure 14:
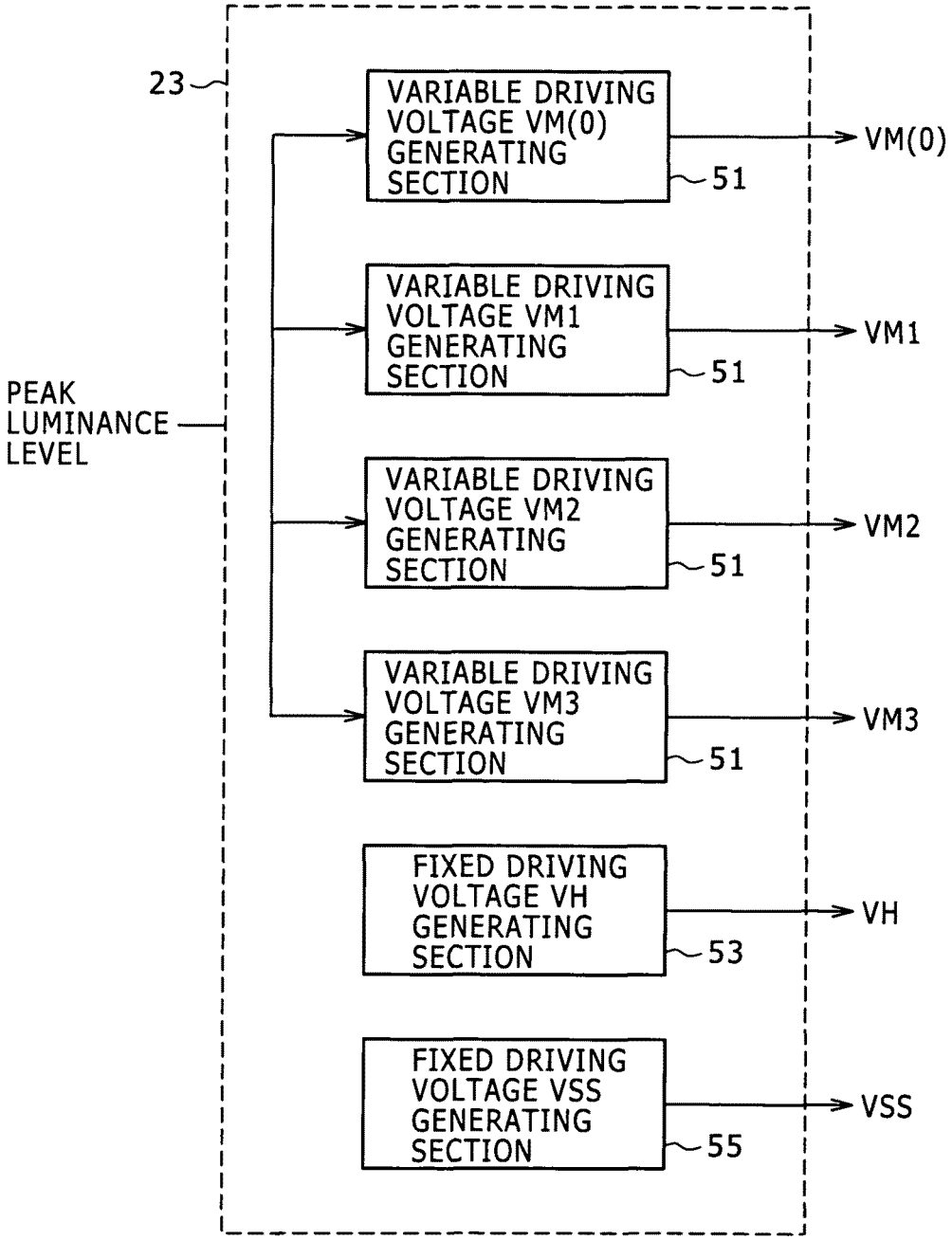
FIG. 14 is a diagram of assistance in explaining an example of circuit configuration of a driving voltage generating section.

FIG. 14 shows an example of circuit configuration of the driving voltage generating section 23. The driving voltage generating section 23 includes four variable driving voltage generating sections 51 for generating a variable driving voltage according to the peak luminance level and fixed driving voltage generating sections 53 and 55 for generating a fixed driving voltage irrespective of the peak luminance level.

Each of the variable driving voltage generating sections 51 stores information on the patterns of output of the driving voltages as described with reference to FIGS. 13A to 13F, and generates the necessary driving voltages VM(0) to VM3 so as to obtain a set peak luminance level.

Incidentally, the fixed driving voltage generating section 53 is to generate the driving voltage VH, and the fixed driving voltage generating section 55 is to generate the driving voltage VSS.

Figure 15A:
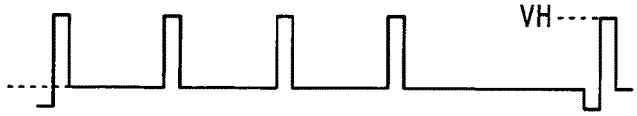
FIGS. 15A, 15B, 15C, 15D, 15E, 15F, and 15G are diagrams showing relation of timing of output of driving voltages and the amplitude of the driving voltages in the lowest luminance mode.
Figure 15B:
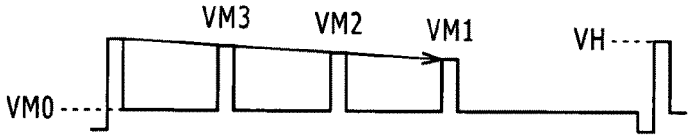
Figure 15C:
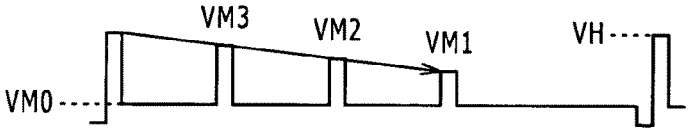
Figure 15D:
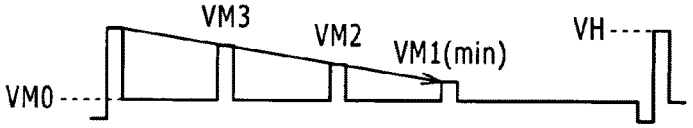

FIGS. 15A, 15B, 15C, 15D, 15E, 15F, and 15G show an image of patterns of output of the driving voltages VM1 to VM3 in the lowest luminance mode. FIG. 15A shows a pattern of output in the low luminance mode in which a maximum luminance in the lowest luminance mode is given. In the lowest luminance mode, as shown from FIG. 15B to FIG. 15C to FIG. 15D, the driving voltage amplitude of the pulse output period at a right end in the figures is decreased as the set peak luminance level is lowered, and the driving voltage amplitudes of the second pulse output period and the third pulse output period from the front in the figures are set such that the driving voltage amplitudes of the second to fourth pulse output periods from the front are decreased in a line.

Figure 15E:
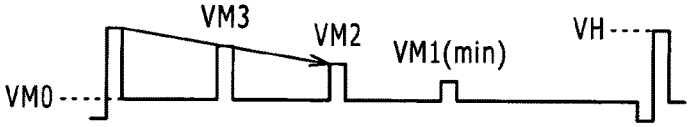
Figure 15F:
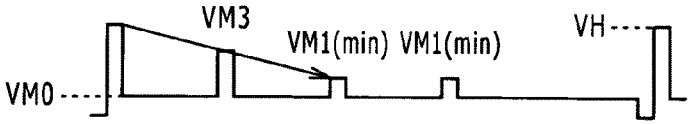

Incidentally, after the driving voltage amplitude in the fourth pulse output period from the front in the figures reaches a variable minimum value (that is, the driving voltage VM1 (min)), the driving voltage amplitude in the third pulse output period from the front in the figures is next set so as to be decreased as shown from FIG. 15E to FIG. 15F.

At this time, the driving voltage amplitude of the second pulse output period from the front in the figures is set such that the driving voltage amplitudes of the second and third pulse output periods from the front are decreased in a line within the emission period.

Figure 15G:
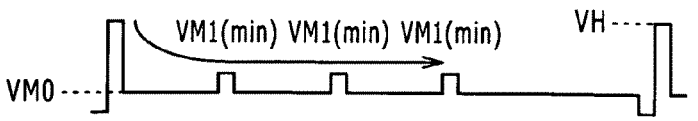

Further, after the driving voltage amplitude in the third pulse output period from the front in the figures reaches the variable minimum value (that is, the driving voltage VM1 (min)), only the driving voltage amplitude in the second pulse output period from the front in the figures is next set so as to be decreased. FIG. 15G shows an output pattern corresponding to the minimum value of the variable peak luminance level.

Figure 16:
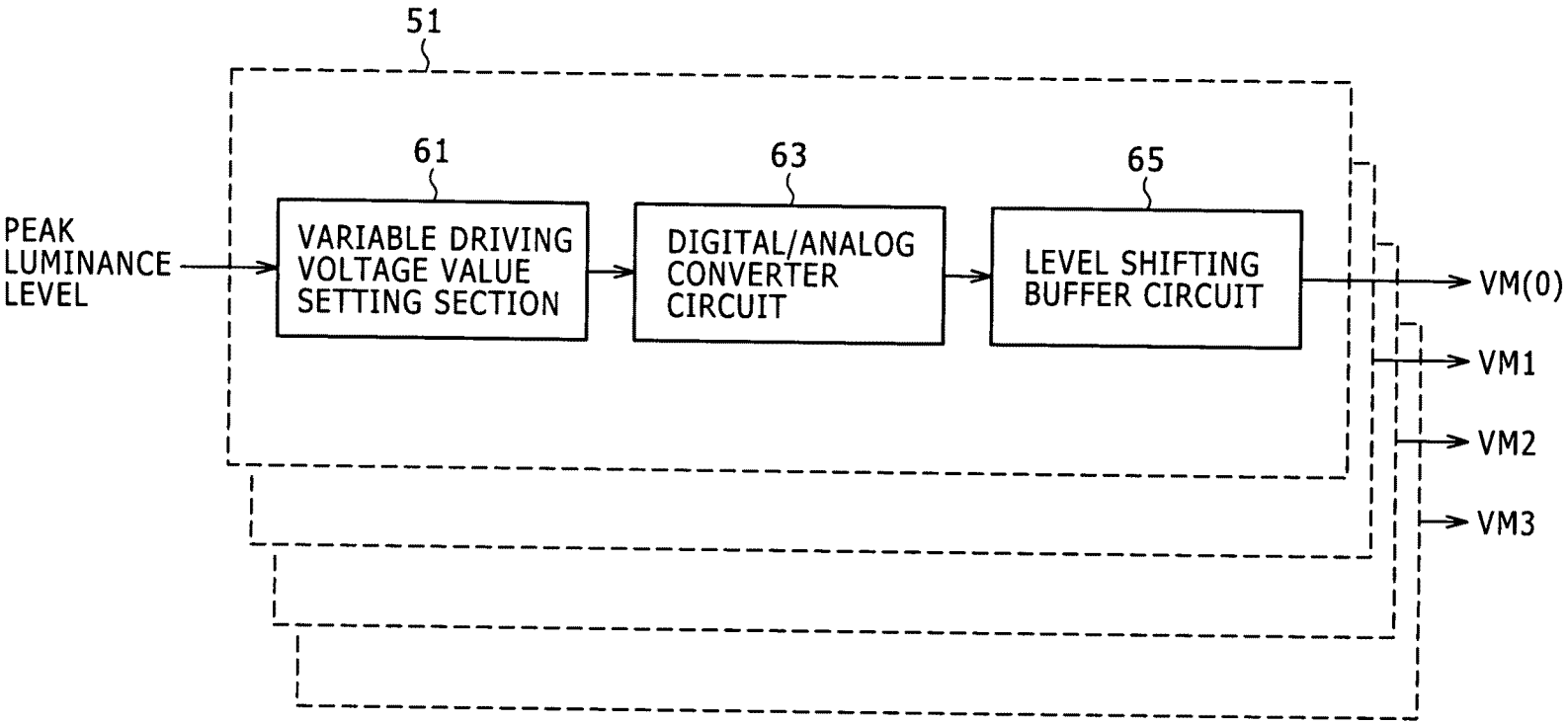
FIG. 16 is a diagram showing an example of circuit configuration of a variable driving voltage generating section.

FIG. 16 shows an example of circuit configuration of a variable driving voltage generating section 51. The variable driving voltage generating section 51 includes a variable driving voltage value setting section 61, a digital/analog converter circuit 63, and a level shifting buffer circuit 65.

The variable driving voltage value setting section 61 is a circuit device for setting a variable driving voltage value corresponding to a detected average luminance level. In the present embodiment, the variable driving voltage value setting section 61 is formed by a look-up table, for example. That is, the variable driving voltage value setting section 61 has the peak luminance level as an input value, and has the variable driving voltage value as an output value.

The digital/analog converter circuit 63 is a circuit device for converting the variable driving voltage value read as a digital value into an analog voltage.

The level shifting buffer circuit 65 is a buffer circuit for converting the level of the analog voltage input from the preceding stage into a voltage level necessary to drive the sub-pixels 25. The output voltage (that is, the driving voltage) of the level shifting buffer circuit 65 is applied to a corresponding power supply line in the output stage circuit 33 (FIG. 5). Of course, the output voltage of the fixed driving voltage generating section 53 is also applied to a corresponding power supply line in the output stage circuit 33 (FIG. 5).

(B-3) Example of Driving Operation of Organic EL Panel Module

Figures 17A, 17B, 17C, 17D, 17E:
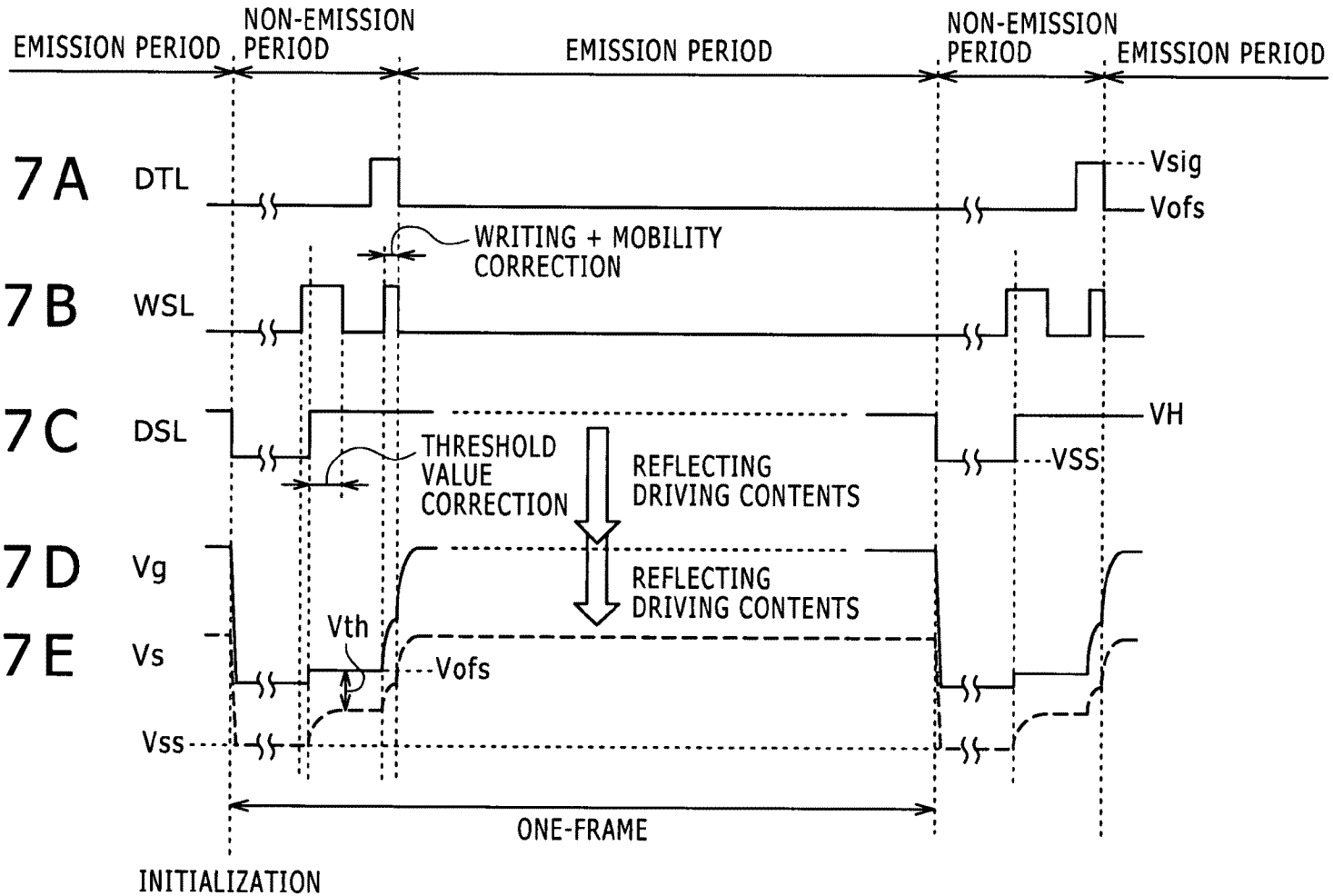
FIGS. 17A, 17B, 17C, 17D, and 17E are diagrams showing an example of driving operation of a sub-pixel.

An example of driving operation of the organic EL panel module will be described in the following with reference to FIGS. 17A, 17B, 17C, 17D, and 17E. Incidentally, FIG. 17A shows the potential waveform of the signal line DTL. FIG. 17B shows the driving waveform of the writing control line WSL. FIG. 17C shows the driving waveform of the power supply line DSL. FIG. 17D shows the potential waveform of the gate potential Vg of the driving transistor N2. FIG. 17E shows the potential waveform of the source potential Vs of the driving transistor N2.

Figure 18:
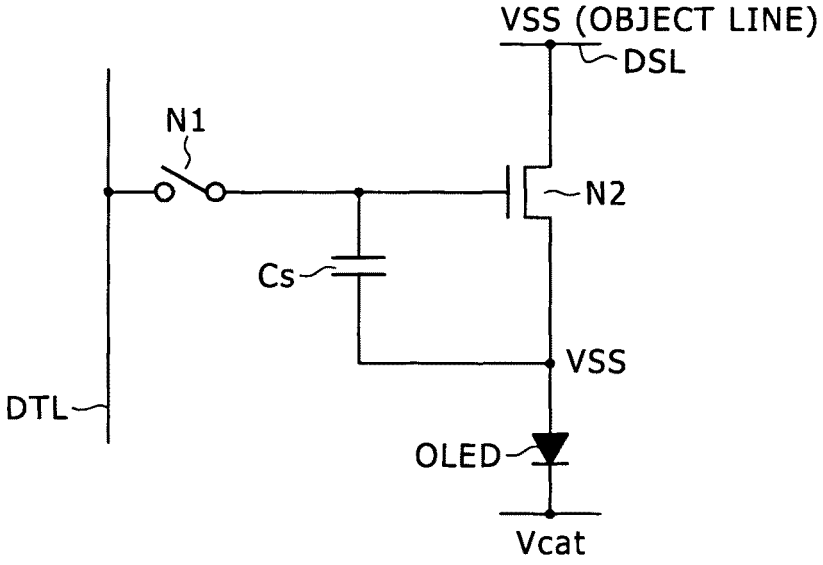
FIG. 18 is a diagram showing a state of connection within a pixel circuit and potential relation at a time of an initializing operation.

An initializing operation will first be described. The initializing operation is an operation of initializing a potential retained by the storage capacitor Cs. This operation is performed by changing the power supply line DSL from a driving power VH to a driving power VSS in a state of the writing control line WSL being at an L-level (FIG. 17B and FIG. 17E). FIG. 18 shows a state of connection within the pixel circuit and potential relation at this point in time. At this time, because the power supply line DSL is decreased to the driving power VSS, the source potential Vs of the driving transistor N2 is decreased to the driving power VSS. Of course, a reverse bias is applied to the organic EL element OLED and thus the organic EL element OLED is quenched.

At this time, the driving transistor N2 is operating in a floating state. Thus, as the source potential Vs of the driving transistor N2 is decreased, the potential of the gate electrode (gate potential Vg) coupled through the storage capacitor Cs is also decreased. This operation is the initializing operation.

This operating state continues until immediately before a start of an operation of correcting variation in threshold voltage Vth of the driving transistor N2 (threshold value correcting operation).

Figure 19:
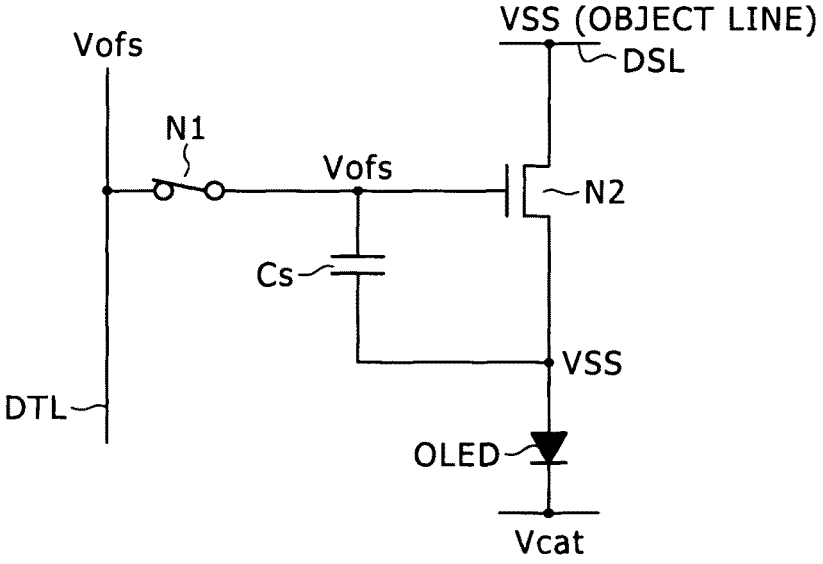
FIG. 19 is a diagram showing a state of connection within the pixel circuit and potential relation at a time of a correction preparatory operation.

Incidentally, in the present embodiment, as shown in FIG. 17B, the writing control line WSL is changed from an L-level to an H-level immediately before a start of the threshold value correcting operation. Because the writing control line WSL is set to the H-level, the sampling transistor N1 performs an on operation, and the gate potential Vg of the driving transistor N2 is set to an offset voltage Vofs (FIG. 17D). This operation is a correction preparatory operation. FIG. 19 shows a state of connection within the pixel circuit and potential relation at this point in time.

Thereafter, the power supply line DSL is changed from the driving power VSS to the driving power VH, whereby the threshold value correcting operation is started (FIG. 17C).

Figure 20:
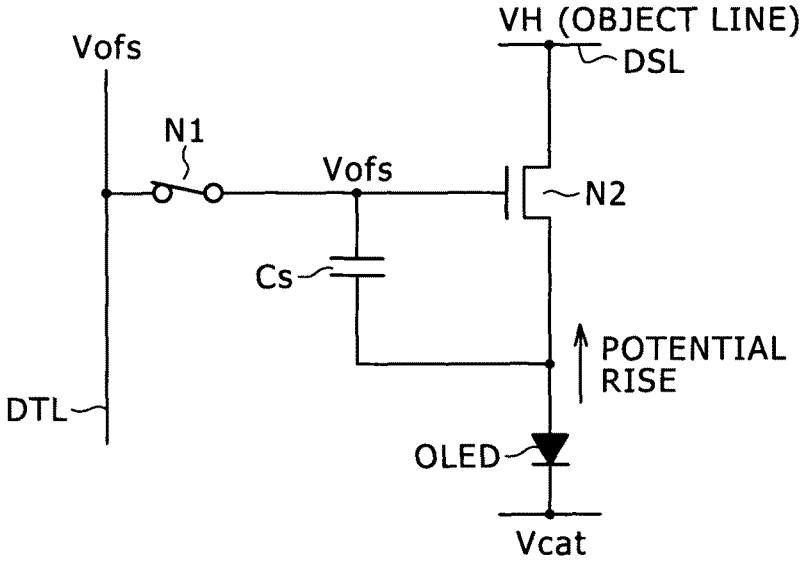
FIG. 20 is a diagram showing a state of connection within the pixel circuit and potential relation at a time of a threshold value correcting operation.
Figure 21:
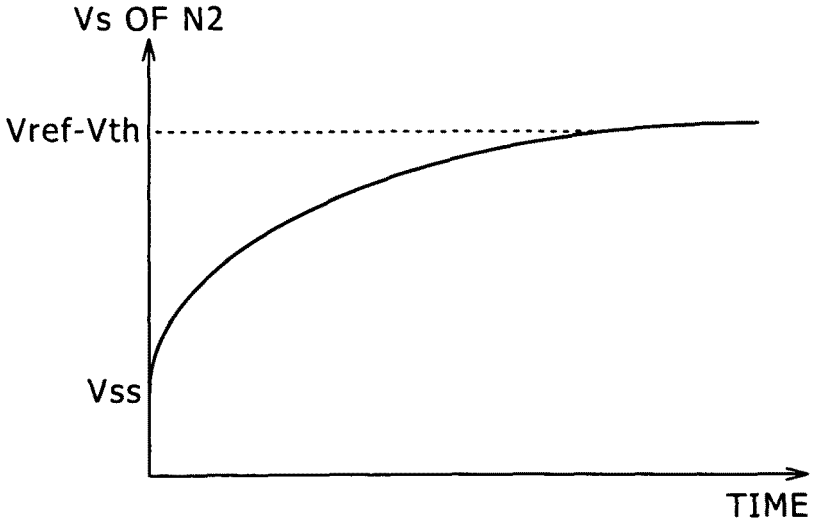
FIG. 21 is a diagram of assistance in explaining the threshold value correcting operation.

When the threshold value correcting operation is started, the driving transistor N2 performs an on operation, and the source potential Vs starts rising. Meanwhile, the gate potential Vg of the driving transistor N2 is fixed at the offset voltage Vofs. The gate-to-source voltage Vgs of the driving transistor N2 is therefore decreased gradually. FIG. 20 shows a state of connection within the pixel circuit and potential relation at this point in time. FIG. 21 shows potential change in the source potential Vs of the driving transistor N2 at the time of the threshold value correcting operation in an enlarged state.

Figure 22:
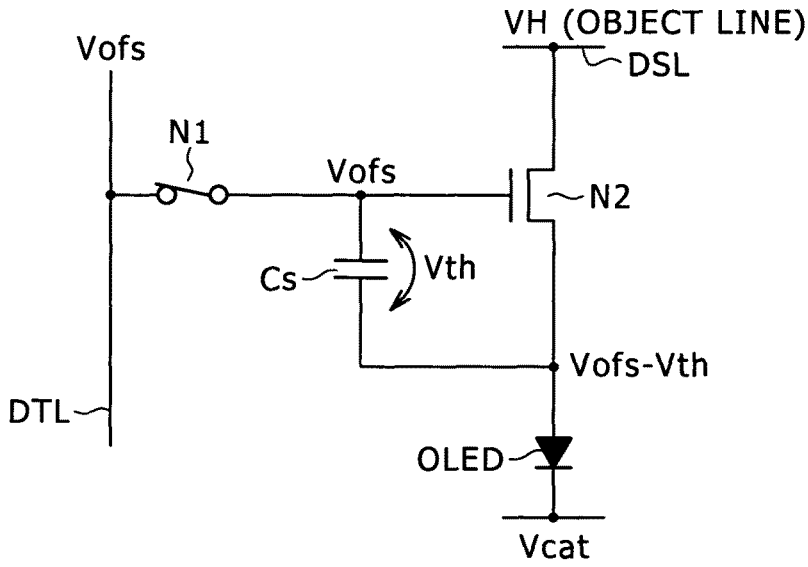
FIG. 22 is a diagram showing a state of connection within the pixel circuit and potential relation at a time of completion of the threshold value correcting operation.
Figure 23:
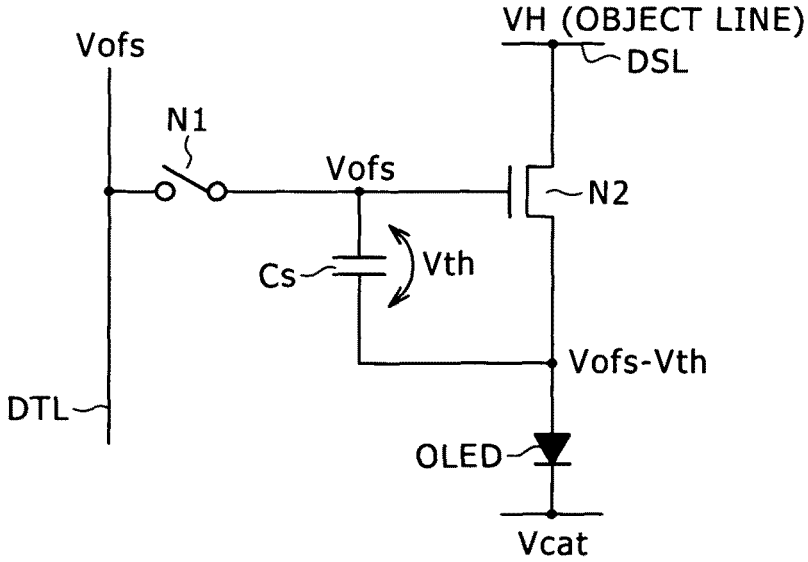
FIG. 23 is a diagram showing a state of connection within the pixel circuit and potential relation in a period from the completion of the threshold value correcting operation to a start of a mobility correcting operation.

As shown in FIG. 21, the potential rise in the source potential Vs of the driving transistor N2 automatically stops when the gate-to-source voltage Vgs of the driving transistor N2 reaches the threshold voltage Vth. FIG. 22 shows a state of connection within the pixel circuit and potential relation at this point in time. This operation is the threshold value correcting operation, which cancels variation in threshold voltage Vth of the driving transistor N2. Incidentally, the potential of the writing control line WSL is changed from the H-level to the L-level in timing set in consideration of variation in time necessary for the threshold value correcting operation (FIG. 17B). FIG. 23 shows a state of connection within the pixel circuit and potential relation at this point in time.

The potential of the signal line DTL is thereafter changed to a signal potential Vsig. Of course, the signal potential Vsig is a potential corresponding to the pixel gradation of the sub-pixel 25 to be written. Incidentally, the signal potential Vsig is written to the signal line DTL before the writing control line WSL is changed to the H-level (FIG. 17A). This is because writing is started with the potential of the signal line DTL changed to the signal potential Vsig.

Figure 24:
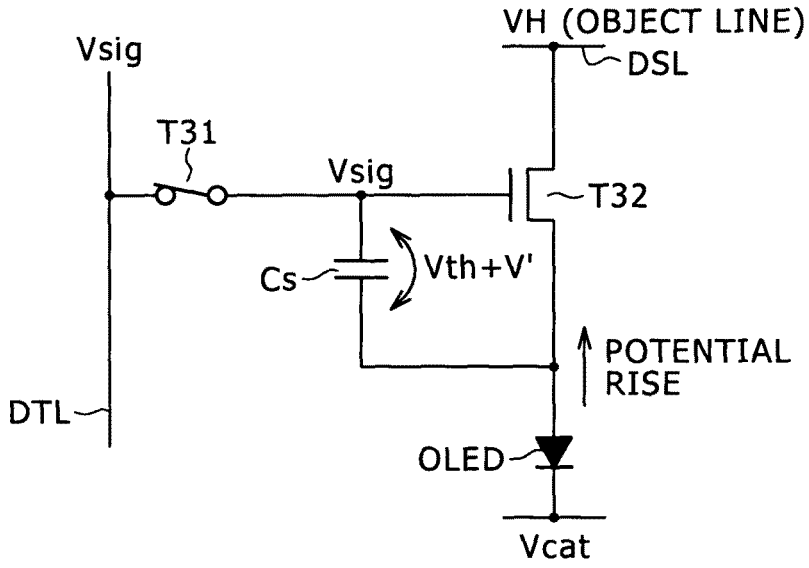
FIG. 24 is a diagram showing a state of connection within the pixel circuit and potential relation at a time of the mobility correcting operation.

The writing control line WSL is controlled to be changed to the H-level in a state of the signal potential Vsig being applied to the signal line DTL and the driving power VH being applied to the power supply line DSL, so that the writing of the signal potential Vsig is started. FIG. 24 shows a state of connection within the pixel circuit and potential relation at this point in time.

As the signal potential Vsig is written, the gate potential Vg of the driving transistor N2 rises, and the driving transistor N2 performs an on operation.

When the driving transistor N2 performs the on operation, a current of a magnitude corresponding to the gate-to-source voltage Vgs is drawn in from the power supply line DSL to charge a capacitive component parasitic on the organic EL element OLED. The charging of the parasitic capacitance raises the anode potential of the organic EL element OLED (source potential Vs of the driving transistor N2). However, the organic EL element OLED does not emit light unless the anode potential of the organic EL element OLED becomes higher by a threshold voltage Vth(oled) than the cathode potential of the organic EL element OLED.

Figure 25:
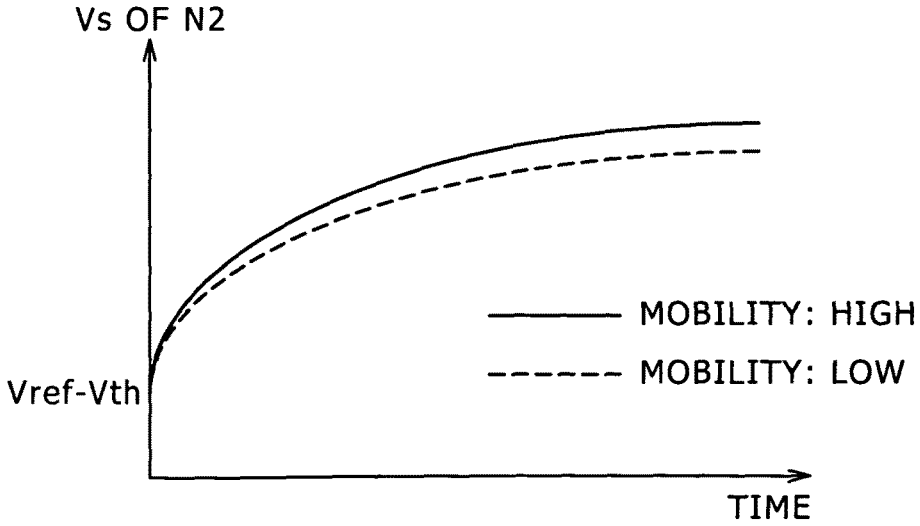
FIG. 25 is a diagram of assistance in explaining the mobility correcting operation.

The current flowing at this time depends on the mobility μ of the driving transistor N2. FIG. 25 shows a difference in rising speed of the source potential Vs due to a difference in mobility μ. As shown in FIG. 25, as the mobility μ becomes higher, the amount of current is increased, and the source potential Vs rises faster. This means that even when a same signal potential Vsig is applied, the gate-to-source voltage Vgs of a driving transistor N2 of high mobility μ is lower than the gate-to-source voltage Vgs of a driving transistor N2 of relatively low mobility μ.

That is, an amount of current flowing through the driving transistor N2 of high mobility μ is smaller than an amount of current flowing through the driving transistor N2 of relatively low mobility μ. Consequently, a correction is made such that when the signal potential Vsig is the same, a current of a same magnitude flows through the organic EL element OLED irrespective of the magnitude of the mobility μ. This operation is mobility correcting operation.

Incidentally, by a point in time that the mobility correcting operation is completed, the anode potential of the organic EL element OLED becomes higher than the threshold voltage Vth(oled), so that the organic EL element OLED performs an on operation. The organic EL element OLED starts emitting light by this on operation.

Figure 26:
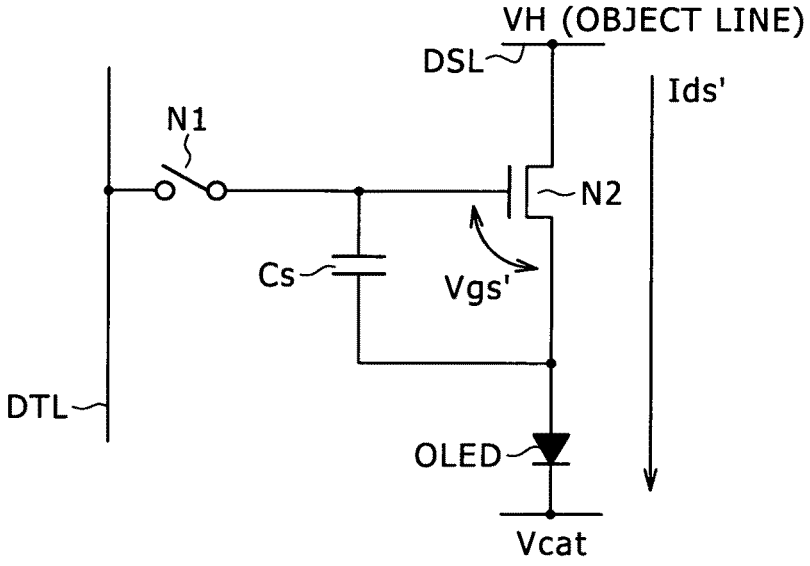
FIG. 26 is a diagram showing a state of connection within the pixel circuit and potential relation in an emission period.

After completion of the writing of the signal potential Vsig, the sampling transistor N1 is controlled to be off, so that the driving transistor N2 operates in a floating state. Thus, as the anode potential is raised by the on operation of the organic EL element OLED, the gate potential Vg of the driving transistor N2 is also raised by a bootstrap operation. FIG. 26 shows a state of connection within the pixel circuit and potential relation at this point in time.

A lit state of the organic EL element OLED thereafter changes according to the amplitude of the driving voltage (driving voltage amplitude) applied to the power supply line DSL.

For example, when the driving voltage VH is applied to the power supply line DSL, the organic EL element OLED can illuminate at a maximum luminance corresponding to the potential retained by the storage capacitor Cs. When the driving voltage VM0 or VSS is applied to the power supply line DSL, for example, the organic EL element OLED is quenched. When the driving voltage VM is applied to the power supply line DSL, for example, the organic EL element OLED illuminates at an intermediate luminance determined according to the potential retained by the storage capacitor Cs and the amplitude of the driving voltage. That is, the state of light emission of the organic EL element OLED is controlled according to the patterns of output of the driving voltages shown in FIGS. 13A to 13F and FIGS. 15A to 15G and a pixel gradation.

(B-4) Summary

As described above, in the present embodiment, the peak luminance level can be controlled by variable control of the driving power VM. At this time, pixel data is not manipulated in any manner. Thus, display performance of gradation representation is not impaired in controlling the peak luminance level.

In addition, when the display mode is the lowest luminance mode, the driving voltage is divided into four pulse waveforms, and is variably controlled such that at least the driving voltage amplitude at one output time is lower than the driving voltage VH for correcting the characteristic of the driving transistor N2. Thereby, the peak luminance level within one frame period can be variably controlled continuously even for an ordinary luminance level or lower. This means that a display panel with a high contrast ratio can be realized.

In addition, when the display mode is the lowest luminance mode, because the driving voltage is divided into four pulse waveforms, light emitting positions can be widely dispersed within one frame period. Thus, the apparent blinking frequency within a frame period can be increased, and therefore the occurrence of flicker can be suppressed effectively even in a case of a low display frame rate.

In addition, as described above, the control of the peak luminance level in the low luminance display mode is achieved by control of the amplitude of the driving voltages alone. This means that the driving current flowing through the organic EL element OLED can be reduced. Thus, a further reduction in power consumption can be achieved. Because power consumption is reduced, this driving technique exerts effects especially when incorporated into a portable type electronic device. Also in the lowest luminance mode, because the peak luminance level can be varied continuously, it is possible to suppress screen glare when the ambience is dark, and enhance display quality.

(C) Second Embodiment

A second embodiment will next be described. In the present embodiment, a case where an image of other than one-segment broadcast programs is displayed is also assumed. That is, a driving technique is proposed which can not only control peak luminance level according to a display mode but also enhance the display quality of an image being displayed at any luminance level.

(C-1) Example of System Configuration

Figure 27:
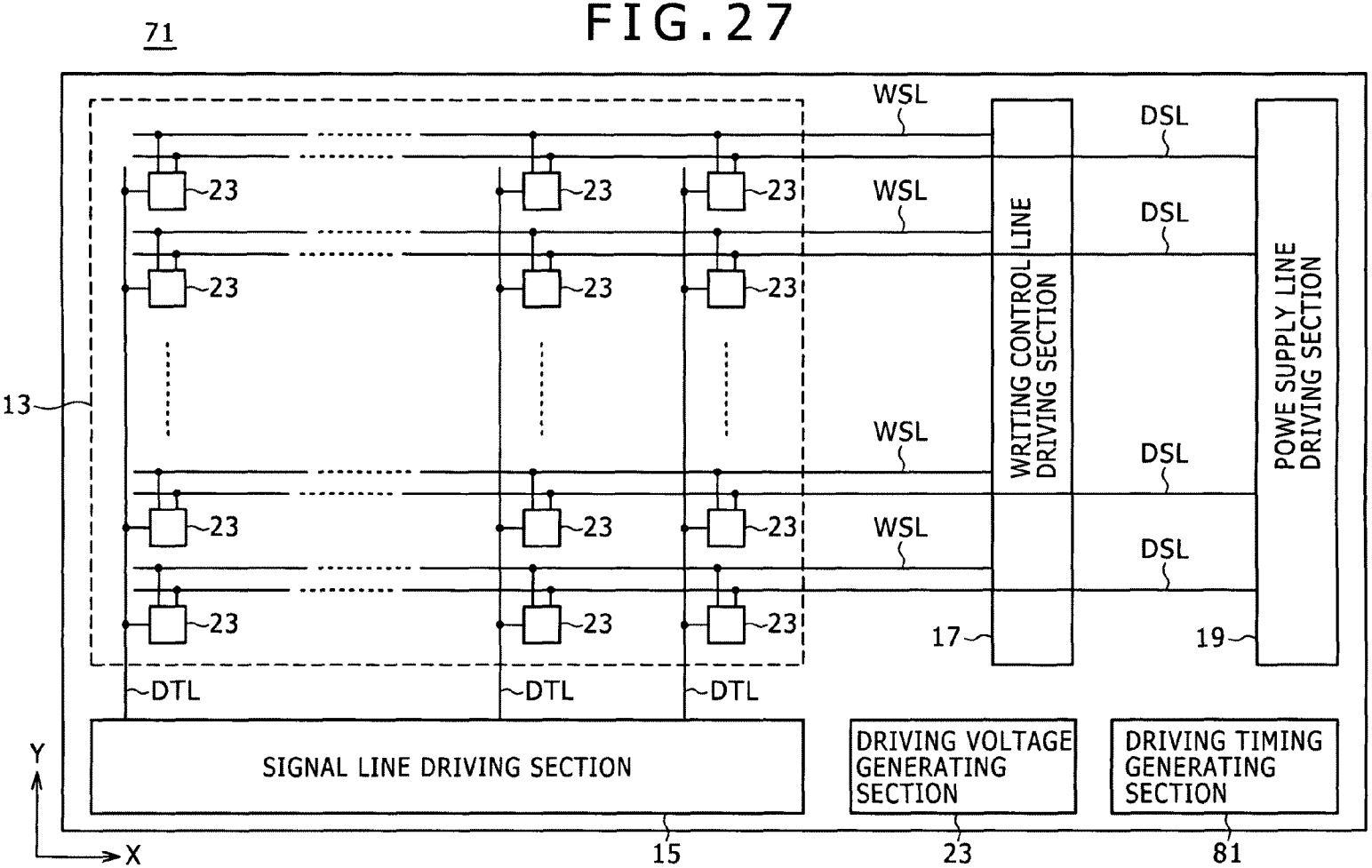
FIG. 27 is a diagram showing an example of configuration of an organic EL panel module.

FIG. 27 shows an example of system configuration of an organic EL panel module 71 according to the present embodiment. Incidentally, in FIG. 27, parts corresponding to those of FIG. 2 are identified by the same reference numerals.

The organic EL panel module 71 has a configuration formed by arranging a pixel array section 13, a signal line driving section 15, a writing control line driving section 17, a power supply line driving section 19, a driving timing generating section 81, and a driving voltage generating section 23 on a single panel.

Description in the following will be made of only the driving timing generating section 81, which is a novel configuration in the present embodiment.

Figure 28:
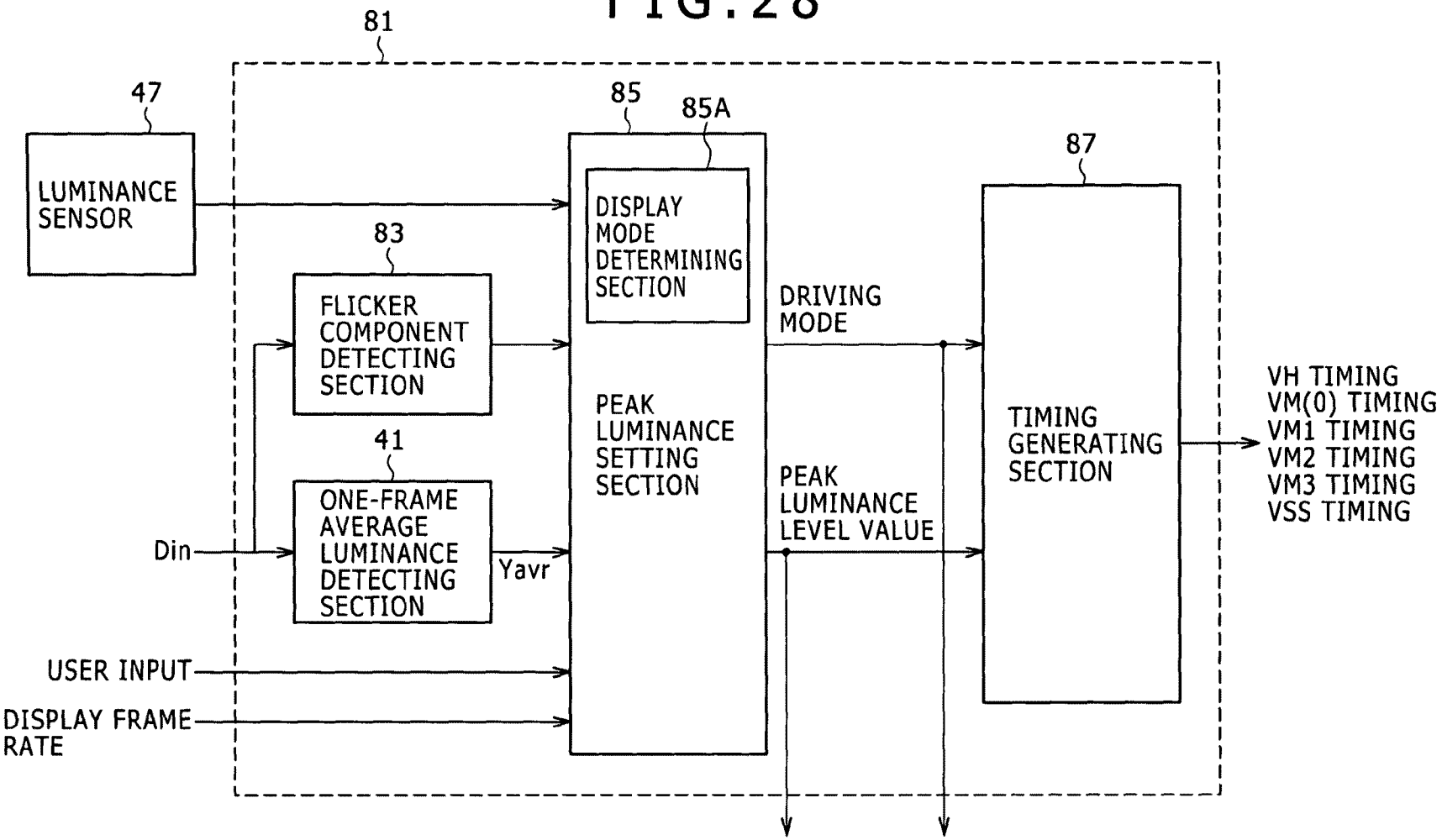
FIG. 28 is a diagram of assistance in explaining an example of circuit configuration of a driving timing generating section.

(C-2) Configuration of Driving Timing Generating Section (a) General Configuration FIG. 28 shows an example of circuit configuration of the driving timing generating section 81. The driving timing generating section 81 includes a one-frame average luminance detecting section 41, a flicker component detecting section 83, a peak luminance setting section 85, and a timing generating section 87.

Each functional part will be described in the following.

(b) Flicker Component Detecting Section

The flicker component detecting section 83 is a circuit device for detecting a moving image component and a flicker component included in an input image on the basis of input image data Din. Incidentally, a method of detecting the moving image component by an average value of motion vectors with respect to a previous frame or a method of detecting the moving image component by a proportion of still pixels in one frame, for example, is applied to the detection of the moving image component.

A method of detecting the flicker component by converting the following conditions into a numerical value, for example, is applied to the detection of the flicker component.

Frame rate

Length of emission time within one frame

Motion quantity

Figure 29:
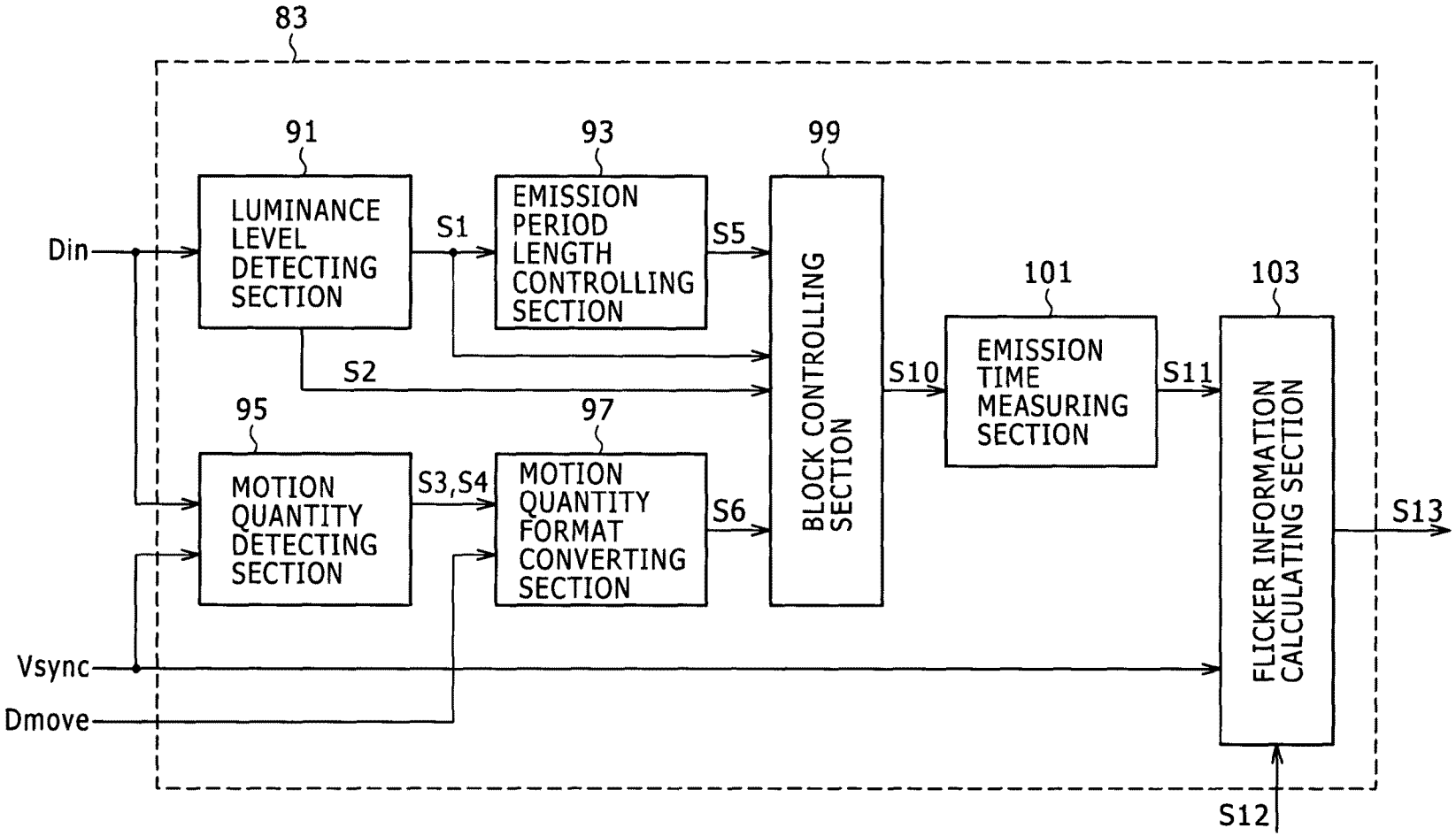
FIG. 29 is a diagram of assistance in explaining an example of circuit configuration of a flicker component detecting section.

Time of continuous appearance of an area whose average luminance level is 50% or more FIG. 29 shows an example of internal configuration of the flicker component detecting section 83. The flicker component detecting section 83 includes a luminance level detecting section 91, an emission period length controlling section 93, a motion quantity detecting section 95, a motion quantity format converting section 97, a block controlling section 99, an emission time measuring section 101, and a flicker information calculating section 103.

(1) Luminance Level Detecting Section

Of these sections, the luminance level detecting section 91 is a circuit device for calculating an average luminance level S1 of the input image data Din corresponding to all pixels forming one frame screen. Incidentally, a same section as the one-frame average luminance detecting section 41 may be used as the luminance level detecting section 91, or the luminance level detecting section 91 may also serve as the one-frame average luminance detecting section 41 described above.

(2) Emission Period Length Controlling Section

The emission period length controlling section 93 is a circuit device for variably controlling the length of an emission period within one frame period on the basis of the average luminance level S1 of the whole of one frame screen. Specifically, the emission period length controlling section 93 controls the emission period length such that the higher the average luminance level S1, the shorter the emission period length, and conversely, such that the lower the average luminance level S1, the longer the emission period length. The emission period length S5 to be used is supplied to the block controlling section 99.

(3) Motion Quantity Detecting Section

The motion quantity detecting section 95 is a circuit device for detecting a motion quantity of each pixel on the basis of the input image data Din.

Figure 30:
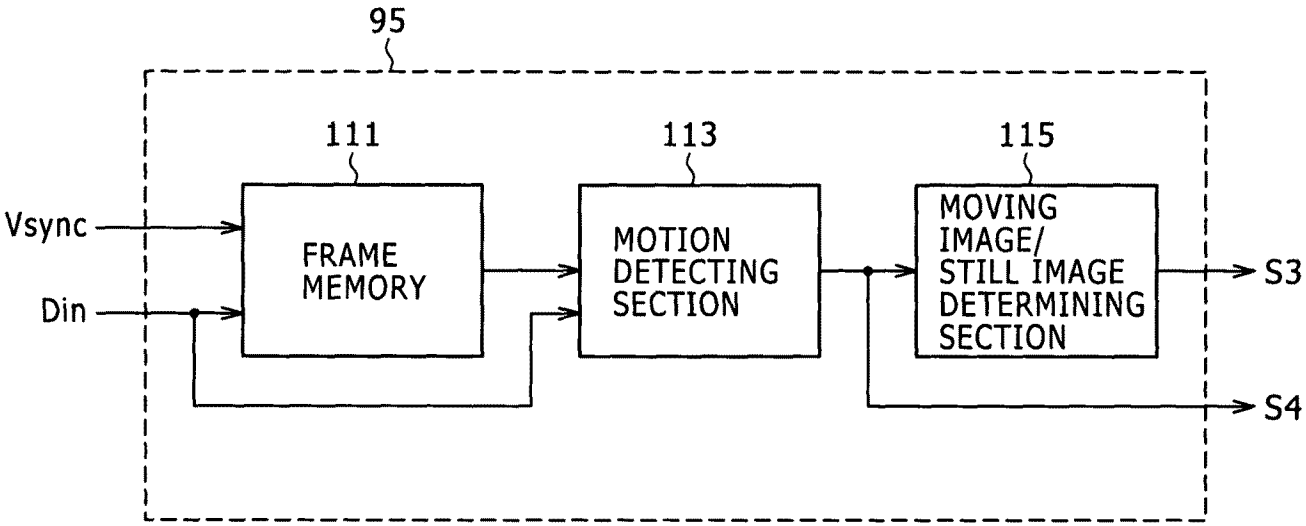
FIG. 30 is a diagram of assistance in explaining an example of circuit configuration of a motion quantity detecting section.

FIG. 30 shows an example of internal configuration of the motion quantity detecting section 95. The motion quantity detecting section 95 includes a frame memory 111, a motion detecting section 113, and a moving image/still image determining section 115.

In the present embodiment, the frame memory 111 has memory areas for two frames. The writing and reading of each memory area are interchanged by a vertical synchronizing signal Vsync. That is, while input image data Din is written to one memory area, the input image data Din of a previous frame is read from the other memory area.

The motion detecting section 113 is a circuit device for detecting a motion quantity S4 in a unit of a number of pixels.

The moving image/still image determining section 115 is a circuit device for determining whether an input image is a moving image or a still image on the basis of the detected motion quantity S4, and outputting a result S3 of the determination.

The moving image/still image determining section 115 basically determines that an image whose motion quantity is zero is a still image. However, the moving image/still image determining section 115 may determine that an image whose motion quantity is very small is a still image. A value in design with experience and the like taken into consideration is used as a determination threshold value in this case.

Incidentally, the present embodiment detects a motion quantity by comparing two frame images with each other. However, other currently available motion detecting techniques can also be used.

For example, motion detecting techniques using a comb filter, motion detecting techniques used in MPEG decoders, motion detecting techniques used in interlace-progressive conversion processing, and other motion detecting techniques can also be used. In addition, a result of detection of these motion detecting functions incorporated by the organic EL panel module 71 can be diverted. In FIG. 29, this kind of motion quantity supplied externally is denoted by Dmove.

For reference, FIG. 31 shows an example of data of a motion quantity Dmove supplied from an MPEG decoder. An externally disposed motion detecting section detects not only a motion quantity but also the direction of the motion quantity and a luminance component. Thus, as shown in FIG. 31, the motion quantity Dmove is supplied as a set of a luminance component 121, a motion vector direction 123, and a motion vector magnitude 125.

(4) Motion Quantity Format Converting Section

The motion quantity format converting section 97 is a circuit device for performing format conversion of the motion quantity S4 or Dmove basically supplied as a number of pixels into a numerical value for operation (which numerical value will be referred to as a "motion value" in the present embodiment). The motion value in this case is one of parameters used to adjust block regions for flicker determination in the block controlling section 99. Generally, flicker is not easily noticeable in a screen with a large motion. Thus, the larger the motion quantity, the larger the value assigned as a motion value.

FIG. 32 shows an example of a table in which correspondences between the motion quantity and the motion value are recorded. In the case of FIG. 32, the motion quantity S4 has six levels of 0, 1, 2, 3, 4, and 5 or more. In the case of FIG. 32, a pixel whose motion quantity magnitude is zero (that is, a still image) is assigned a motion value "1.0." In addition, in the case of FIG. 32, pixels whose motion quantity magnitude is other than zero (that is, a moving image) are assigned a motion value that is increased in proportion to the motion quantity magnitude. Incidentally, increasing the motion value without limitation can interfere with flicker determination as an original purpose. Accordingly, in the case of FIG. 32, when the motion quantity is 5 or more, an increase in motion value is limited to "1.5."

Specifically, when the motion quantity is increased by one pixel, the motion value is increased by "0.1." This correspondence functions such that an increase of one pixel in motion quantity causes an increase of 10% of a reference area (area when the motion quantity is zero).

Incidentally, when the motion quantity is externally supplied as motion quantity Dmove as described above, the magnitude of the motion vector is converted into a number of pixels, and then converted into a motion value. Of course, FIG. 32 is an example, and the number of levels of the motion quantity and corresponding change width are arbitrary.

(5) Block Controlling Section

The block controlling section 99 is a circuit device for determining the number, position, and area of block regions used in a flicker determination process.

Figure 33:
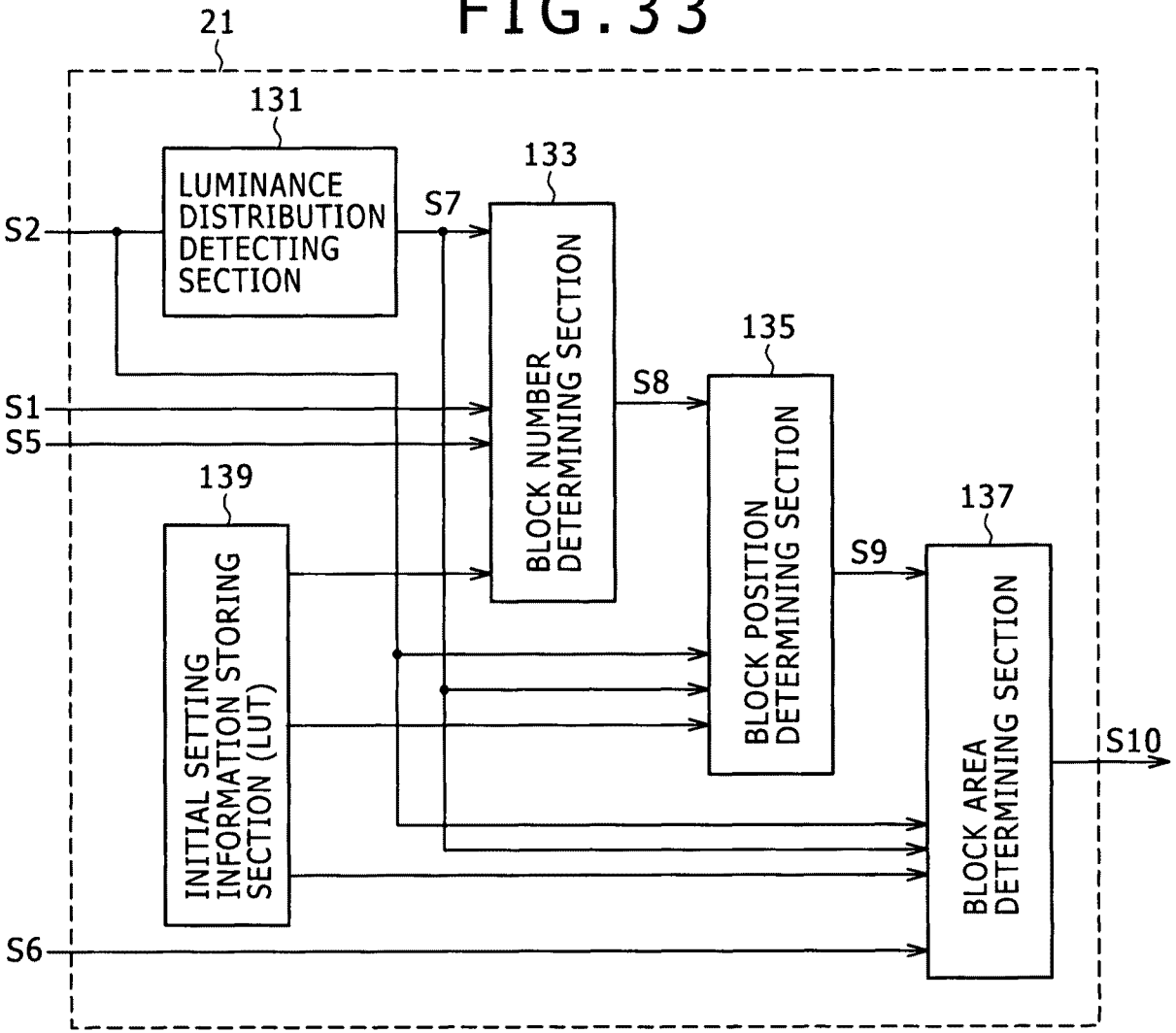
FIG. 33 is a diagram of assistance in explaining an example of circuit configuration of a block controlling section.

FIG. 33 shows an example of internal configuration of the block controlling section 99. The block controlling section 99 includes a luminance distribution detecting section 131, a block number determining section 133, a block position determining section 135, a block area determining section 137, and an initial setting information storing section 139.

The luminance distribution detecting section 131 is a circuit device for detecting a region having a high luminance level on the basis of a luminance level S2 obtained for each pixel. The luminance distribution detecting section 131 uses 50% of a luminance level (100% is a maximum gradation value) as a determination threshold value, and outputs a result of comparison of the determination threshold value with each luminance level S2 as luminance distribution information S7. In the present embodiment, a pixel whose luminance level is higher than the determination threshold value is indicated by a value "1," and a pixel whose luminance level is lower than the determination threshold value is indicated by a value "0."

In the present embodiment, 50% of the luminance level is used as a threshold value because flicker is more visible in a brighter region. Of course, this condition is one example, and flicker is not visible unless other conditions are satisfied as described below.

Thus obtaining the luminance distribution information S7 in advance can reduce an amount of operation necessary in each processing section in a succeeding stage.

A result of determination is supplied as luminance distribution information S7 to the block number determining section 133, the block position determining section 135, and the block area determining section 137. Incidentally, a high-resolution display device has a large number of pixels. Thus, a method may be adopted in which the luminance distribution information S7 is stored in a memory such as a RAM or the like and each processing section in a succeeding stage accesses the memory.

The block number determining section 133 is a circuit device for determining the number of blocks used in the flicker determination process. The determination process in this case is performed in two divided stages.

A process in the first stage determines on the basis of the average luminance level S1 of the entire screen and the emission period length S5 whether a flicker component included in an input image is "dispersed" or "concentrated" within the screen.

In the present embodiment, the block number determining section 133 determines that the flicker component is a "dispersed type" when the following two conditions are satisfied at the same time, and otherwise determines that the flicker component is a "concentrated type."

The average luminance level S1 of the entire screen is 50% or more (the maximum gradation value is set as 100%)

The emission period length S5 is 60% or less of one frame period (one frame period is set as 100%)

Incidentally, in the present embodiment, consideration will be given to a case where the emission period length is set in a range of 25% to 50%. Thus, the second condition is satisfied unconditionally.

When it is determined that the flicker component is a "dispersed type," the block number determining section 133 sets a block number S8 to "1." When it is determined that the flicker component is a "concentrated type," on the other hand, the block number determining section 133 sets the block number S8 through a process in the second stage.

The process in the second stage determines the number of blocks according to an input screen on the basis of the luminance distribution information S7 and initial setting information (number, position, and area) for determination blocks prepared in advance.

Figure 34:
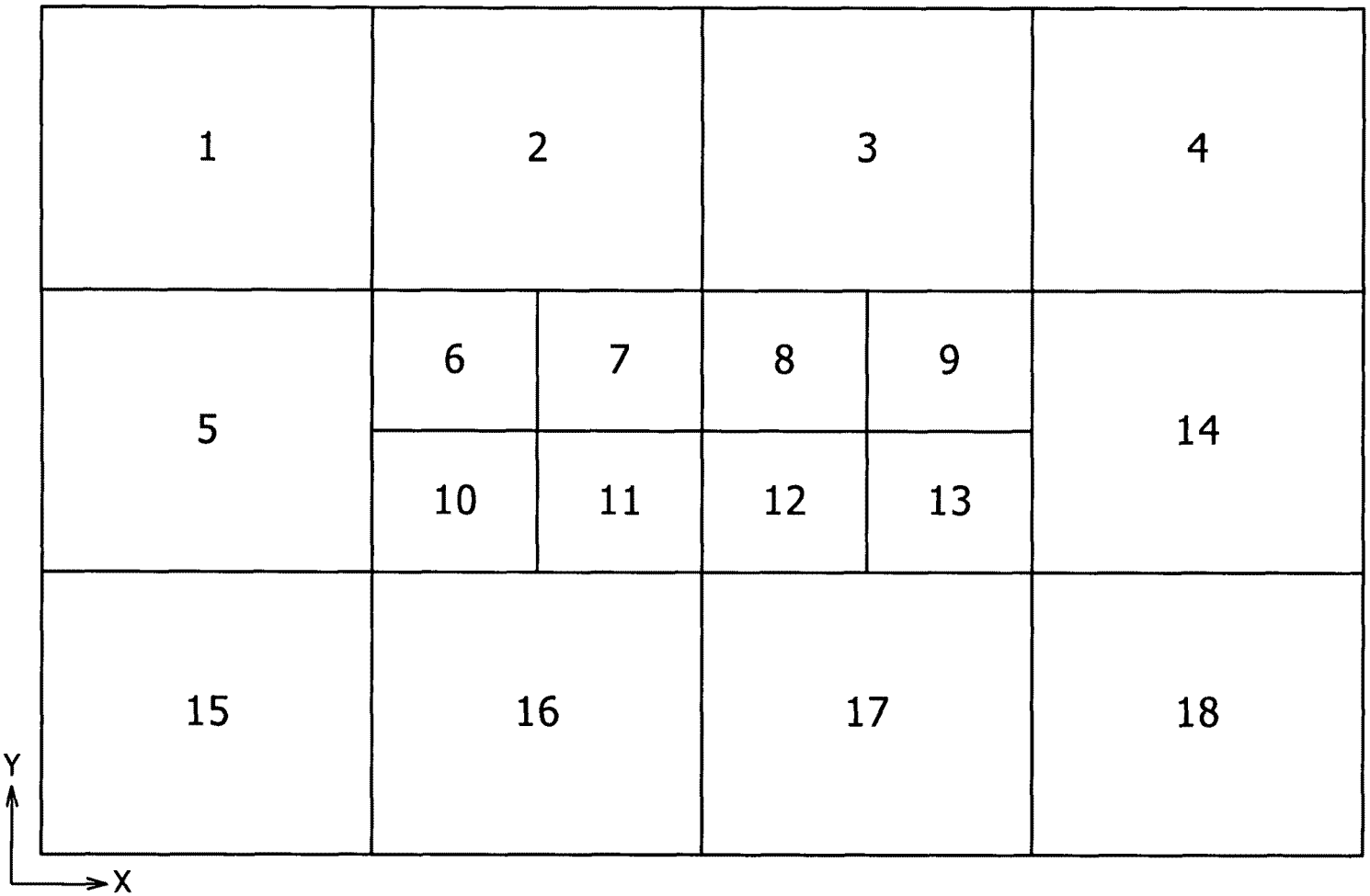
FIG. 34 is a diagram showing an example of initial setting of determination blocks.

FIG. 34 shows an example of initial setting of the determination blocks. As described above, the flicker component is recognized on a condition that the flicker component have an area region of 10% or more of the entire screen. Thus, block areas at the time of the initial setting are set in a range of 5% to 10% of the entire screen at a maximum. In addition, flicker tends to be noticeable around the center of the screen as compared with the periphery of the screen. Thus, at the time of the initial setting, as shown in FIG. 34, blocks around the center are set at one fourth of the area of peripheral regions. In FIG. 34, blocks corresponding to serial numbers "6" to "13" correspond to the blocks around the center.

In this case, the block number determining section 133 assigns each block region (FIG. 34) prepared in the initial setting information storing section 139 corresponding luminance distribution information S7 of an input image determined to be the concentrated type, and determines whether or not the average luminance level of the block region is 50% or more of the gradation luminance. In the present embodiment, the number of pixels (value "1") whose average luminance level is determined to exceed 50% of the gradation luminance in the luminance distribution information S7 corresponding to each block region and the number of pixels (value "0") whose average luminance level is determined to be less than 50% of the gradation luminance in the luminance distribution information S7 are compared with each other, and whether or not the average luminance level of each block region is 50% or more is determined according to which of the numbers is larger.

For example, when the average luminance level of a certain block region is determined to be less than 50% of the gradation luminance (when the number of values "0" is larger than the number of values "1"), the block number determining section 133 counts the block region as one block region, or counts a set of the block region and a plurality of adjacent block regions as one block region. For example, already fragmented blocks as around the center are counted as one block region in a range not exceeding 10% of the entire screen on a condition that the block regions adjacent to each other have a same determination result.

Figure 35:
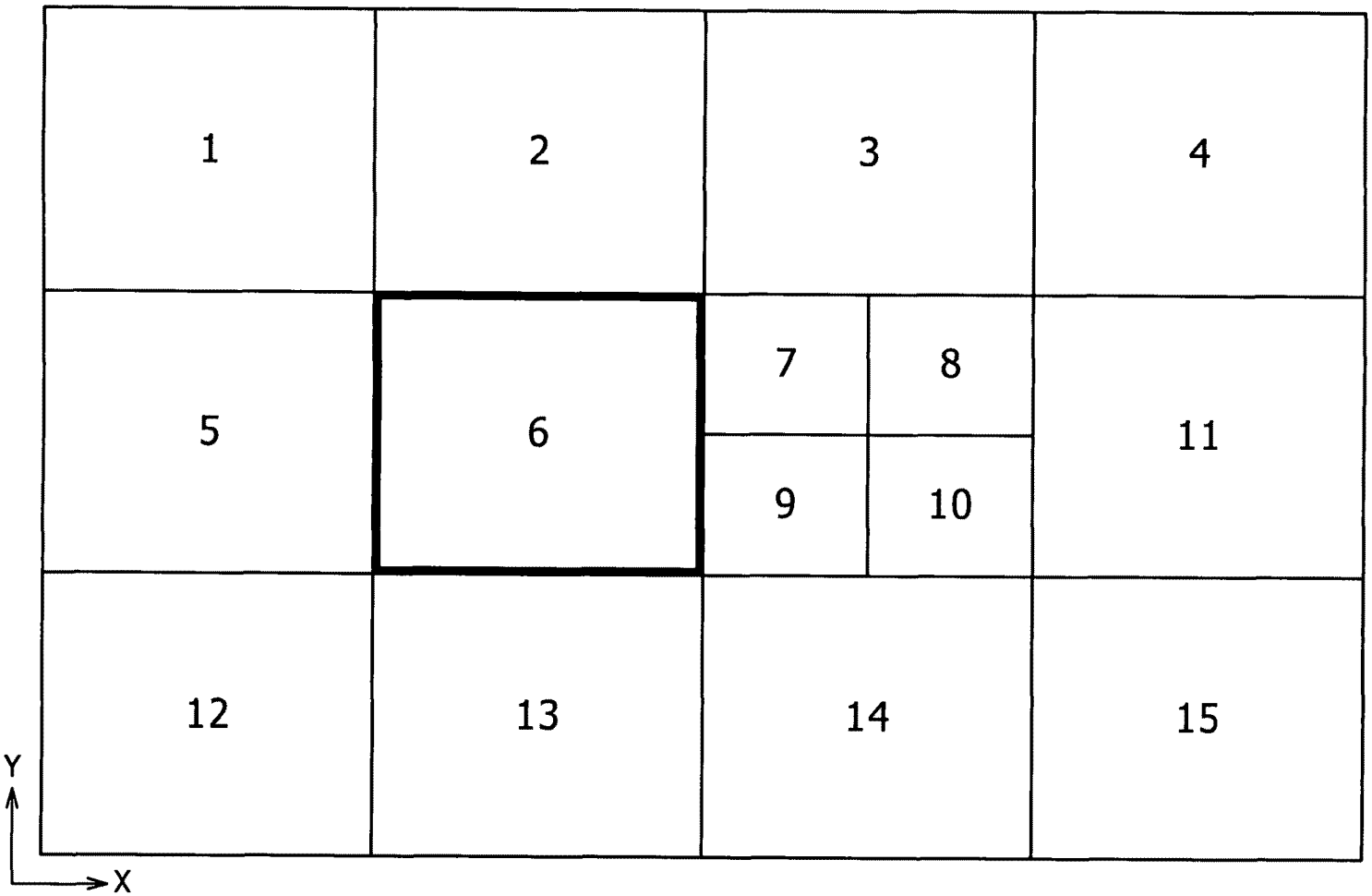
FIG. 35 is a diagram of assistance in explaining an operation of uniting block regions.

FIG. 35 shows an example of an image after union. FIG. 35 represents a state in which when the average luminance levels of blocks "6," "7," "10," and "11" in FIG. 34 are each less than the threshold value, these four blocks are treated as one block. In this case, the number of block regions for determination is changed from 18 in an initial state to 15.

On the other hand, when the average luminance level of a certain block region is determined to be 50% or more of the gradation luminance (when the number of values "0" is smaller than the number of values "1"), the block number determining section 133 determines the number of block regions into which to fragment the certain block region in consideration of the initial state of the block region and the position of the block region (whether the block region is around the center or in a peripheral region). For example, a block situated in a peripheral part is divided into two blocks or more.

Figure 36:
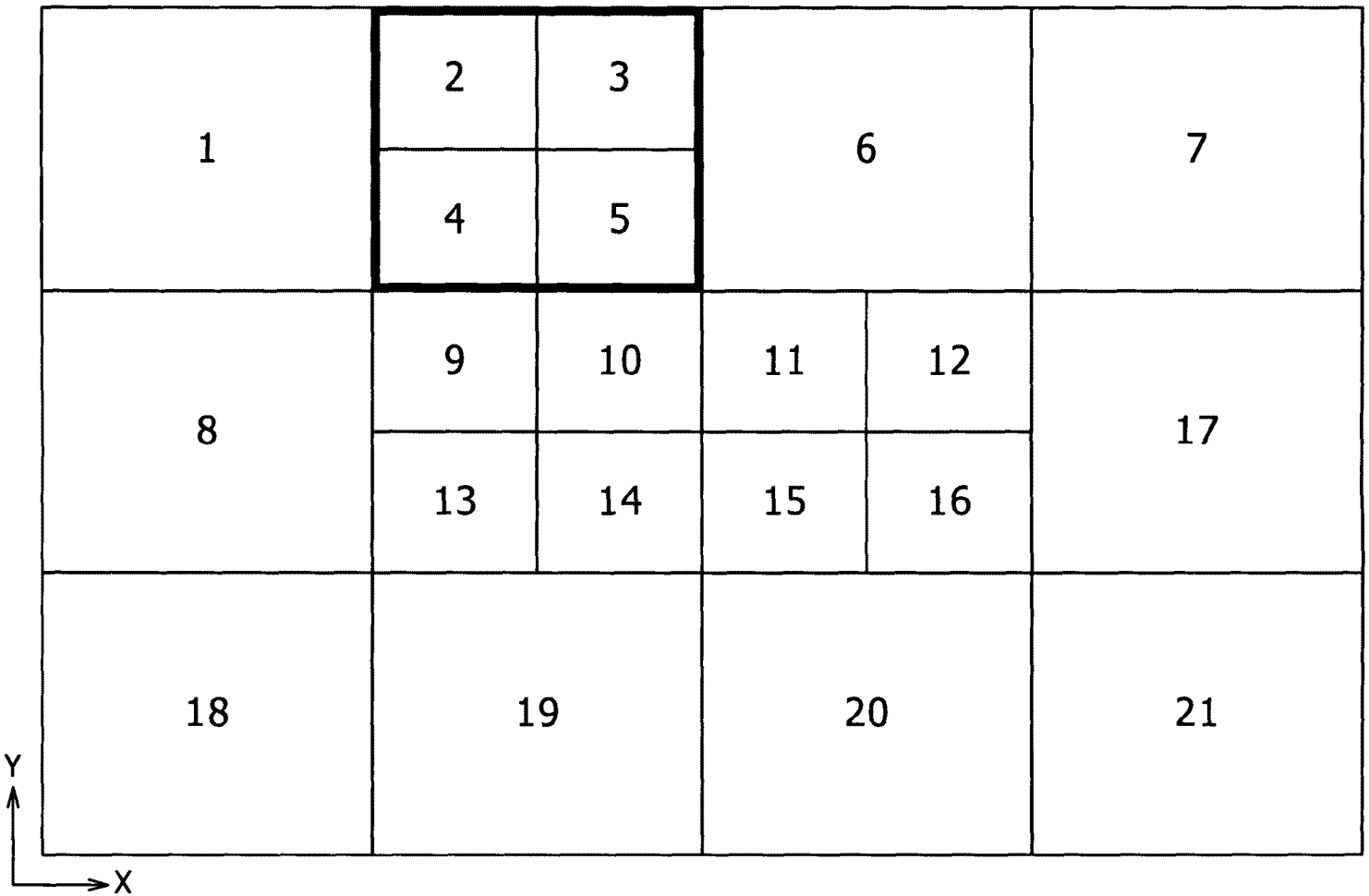
FIG. 36 is a diagram of assistance in explaining an operation of dividing a block region.

FIG. 36 shows an example of an image after division. FIG. 36 represents a state in which when the average luminance level of a block "2" in FIG. 34 is the threshold value or higher, the block is divided into four block regions. In this case, the number of block regions for determination is changed from 18 in the initial state to 21.

The block number S8 determined through such a process is supplied to the block position determining section 135. Incidentally, the smaller the areas of block regions, the higher the accuracy of flicker determination. However, when the number of block regions becomes too large, an amount of necessary operation also becomes excessive. Therefore the number of block regions is desirably limited to an appropriate number.

The block position determining section 135 determines positional information S9 for each block on the basis of the luminance distribution information S7, the block number S8, and the initial setting information (position) for the determination blocks prepared in advance.

Incidentally, when the number of block regions is one (in the case of the "dispersed type"), the entire screen forms one block. Thus, the block position determining section 135 does not need to determine the block region positional information S9 individually. In this case, the block position determining section 135 outputs one reference position set in advance as positional information S9.

On the other hand, when a plurality of block regions are determined (in the case of the "concentrated type"), the block position determining section 135 refers to the luminance distribution information S7, and determines the positional information S9 such that a large number of block regions are assigned to a region where many of the pixels having a high luminance level concentrate.

However, at this point in time, only the number of blocks is determined, and the area of each block is not determined yet.

Thus, referring to the initial setting information, coordinates of a starting point of a block (for example coordinates of the upper right of the block), center coordinates or the like is given by XY coordinates. For a region of low luminance level, for example, the positional information of the block region set in the initial setting information is used as it is. For a region of high luminance level, for example, the positional information S9 is determined such that the block region set in the initial setting information is divided as in the block number determining section 133.

The block area determining section 137 is a circuit device for determining the areas of corresponding blocks on the basis of the motion value S6 and the luminance distribution information S7. The block area determining section 137 outputs a successively calculated block area S10 to the emission time measuring section 101.

Incidentally, when the number of pieces of supplied positional information S9 is one (in the case of the "dispersed type"), the entire screen forms one block region, and therefore the area does not need to be determined.

When a plurality of pieces of positional information S9 are given (in the case of the "concentrated type"), on the other hand, the block area determining section 137 calculates the area of each block corresponding to the positional information S9 on the basis of the following equation.

$$\text{Block Area}=(\text{Area of 10\% of Total Display Region})\times\text{Luminance Level Value}\times\text{Motion Value} \quad \text{(Equation 1)}$$

The luminance level value in this case is one of parameters used to adjust the block area. The luminance level value is given as the average luminance level of all pixels situated within a block region (block region having an area of 10% of a total display region) positioned on the basis of the positional information S9.

Incidentally, the shape of the positioned block region may be a square shape, or may be a shape retaining the aspect ratio of the screen. In the present embodiment, a method of making the shape of the block region coincide with the aspect ratio of the screen is adopted.

In addition, the average luminance level is calculated as an average value of the luminance levels S2 of all pixels situated within each block region.

FIG. 37 shows an example of a table of correspondences between the luminance level and the luminance level value. Generally, flicker is perceived more easily as the luminance level is increased. Accordingly, in the present embodiment, a block region having a higher luminance level is assigned a lower luminance level value to be decreased in area. Incidentally, a reduction in area of a block region disposed in a high-luminance region increases the accuracy of detection of the area of the high-luminance region, and increases the accuracy of detection of flicker.

In the case of FIG. 37, six levels of 50% to 55%, 55% to 60%, 60% to 65%, 65% to 70%, 70% to 75%, and 75% or more are prepared as the luminance level.

In the case of FIG. 37, a block whose luminance level is 50% to 55% is assigned a luminance level value "1.0." In addition, in the case of FIG. 37, the luminance level value is assigned such that the luminance level value is decreased as the luminance level is increased by one step. Specifically, when the class of the luminance level is increased by one step, the luminance level value is decreased by "0.1." This correspondence means that an increase in luminance level by one step causes a decrease of 10% of a reference area (area when the luminance level is 50% to 55%).

Figure 38:
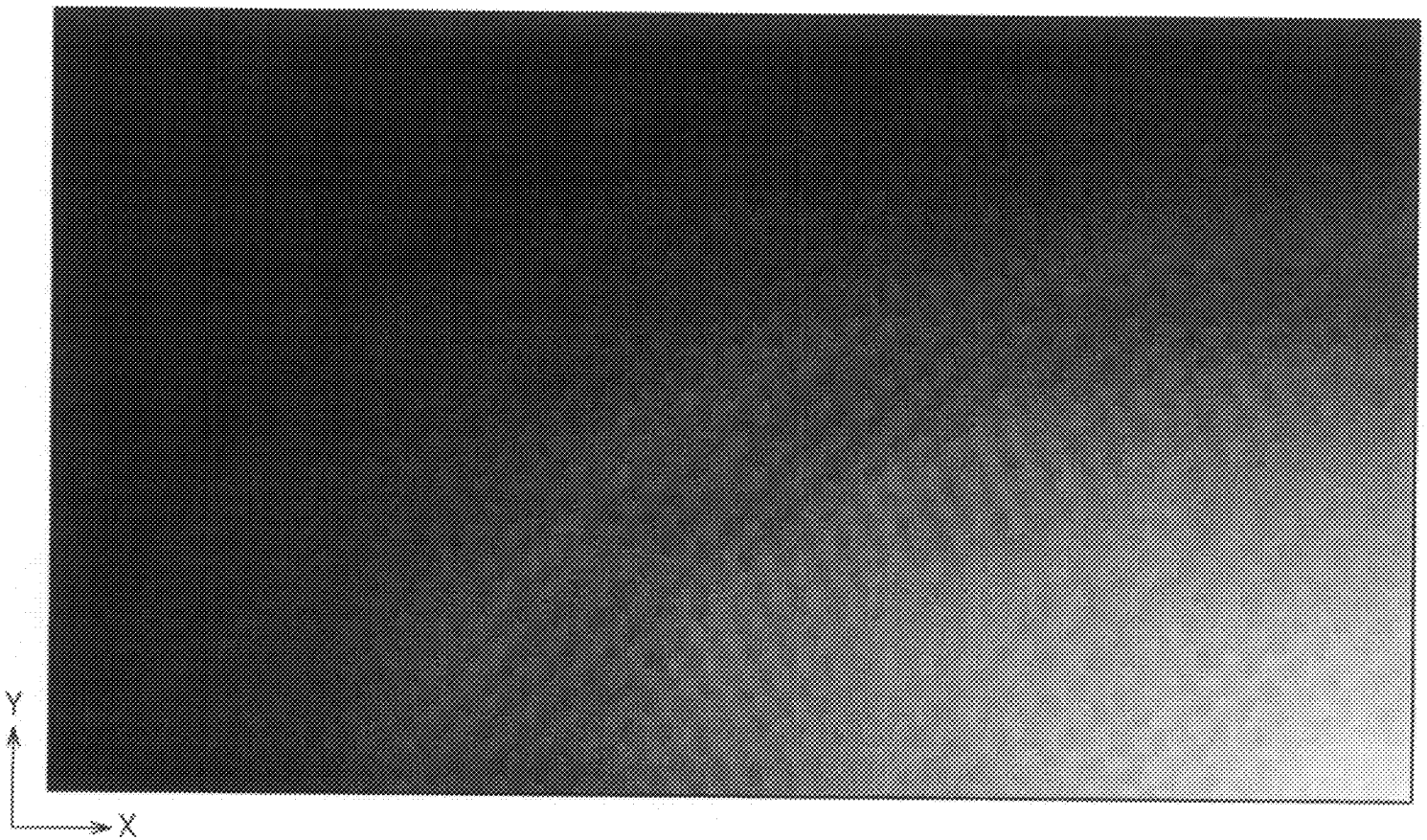
FIG. 38 is a diagram showing an example of an input image.
Figure 39:
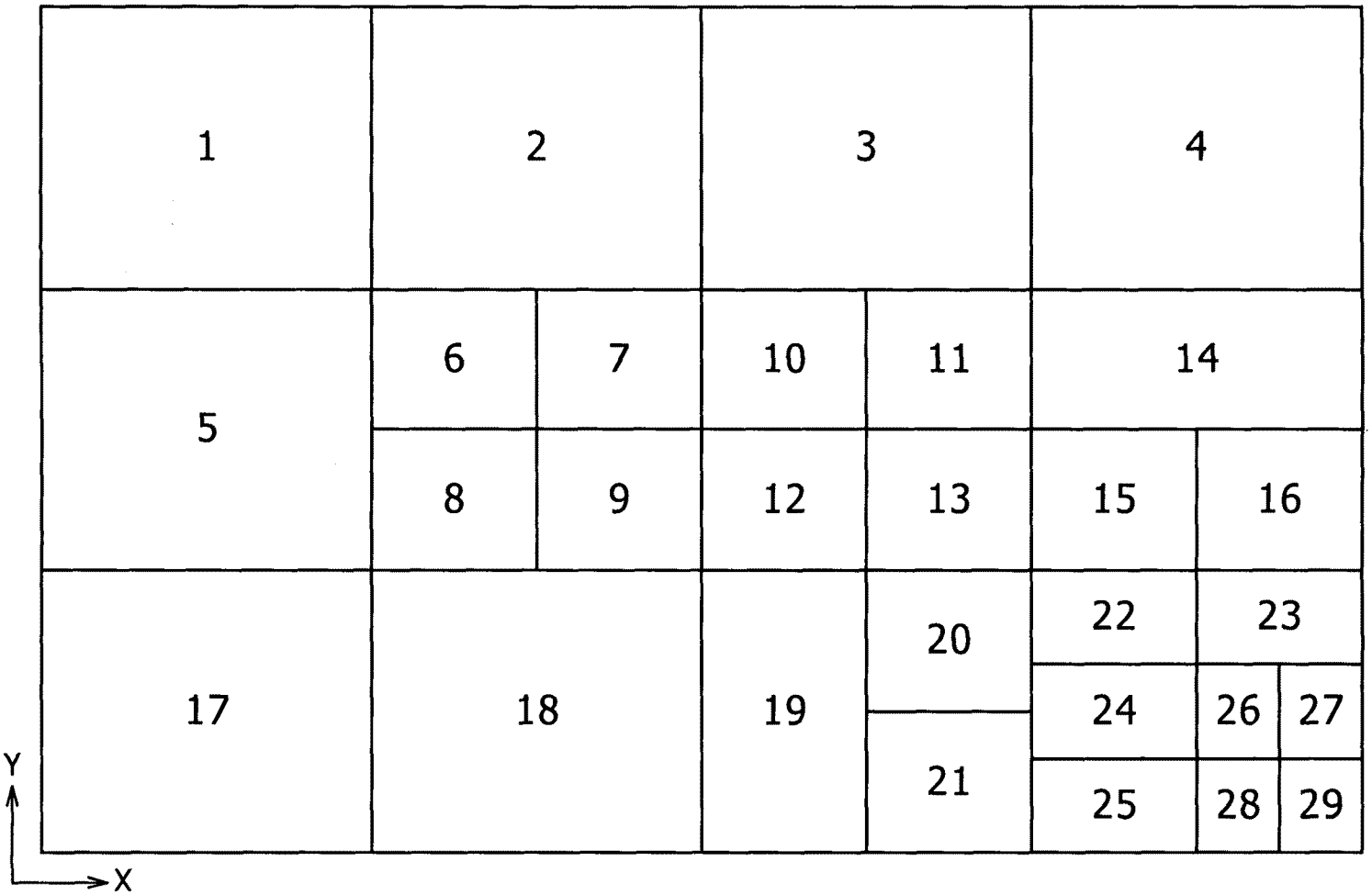
FIG. 39 is a diagram showing an example of output of a block area determining section.

FIG. 38 and FIG. 39 are used to show an example of a result of processing by the block area determining section 137. FIG. 38 shows an example of an input image. Incidentally, the input image shown in FIG. 38 represents a case where a motion quantity is zero and luminance concentrates in a lower right corner of the screen.

FIG. 39 shows an example of output of the block area determining section 137. Many blocks are arranged in the lower right corner of the screen in the stage of the block position determining section 135, and many small-area blocks are arranged in the lower right corner of the screen as a result of area calculation based on Equation 1.

The initial setting information storing section 139 is a storage area for storing the initial values of the number, position, and area of blocks for flicker determination, as described above.

(6) Emission Time Measuring Section

The emission time measuring section 101 (FIG. 29) is a circuit device for detecting a high-luminance region having an area equal to or more than a certain area, and measuring the emission time of the high-luminance region. This is because flicker is not visible unless there is not only a bright image or an image with a small motion but also a continuous emission in an area equal to or more than a certain area for a time equal to or more than a certain time.

Thus, the emission time measuring section 101 performs the following process. First, the emission time measuring section 101 detects block regions whose average luminance level is 50% or more of the gradation luminance among block regions set in the process in the previous stage. Next, the emission time measuring section 101 combines block regions adjacent to each other or overlapping each other among the detected block regions into one block region, and determines the area of the block region after the combination.

Further, when detecting at least one combined block whose calculated area is 10% or more of the entire display region, the emission time measuring section 101 measures a time from a start of detection to non-detection. Incidentally, a maximum number of block regions whose area is 10% or more of the display region is 10. Suppose in the present embodiment that the emission times of the 10 block regions can be measured simultaneously.

The area and measured value of a block region that has become an object for measurement of an emission time are supplied as emission time information S11 to the flicker information calculating section 103.

Incidentally, when the input image is of the dispersed type (when the entire screen is bright on average, and a total emission period length is equal to or more than a threshold value), the emission time measuring section 101 outputs the emission time and the average luminance level of the input image as emission time information S11 while a result of detection indicating that the input image is of the dispersed type is obtained.

(7) Flicker Information Calculating Section

The flicker information calculating section 103 is a circuit device for calculating flicker information on the basis of the emission time information S11 and a frame rate S12. Incidentally, the flicker information calculating section 103 calculates the flicker information when the time length of the emission time information S11 is nonzero. Incidentally, when there are a plurality of regions that have become an object for measurement of the emission time information S11, flicker information may be calculated for all the regions, or flicker information may be calculated for only a region where flicker tends to be most noticeable (that is, a region having a largest area).

The flicker information calculating section 103 calculates the flicker information on the basis of the following equation.

$$\text{Flicker Information} = \text{Frame Rate Value} \times \text{Area Value for Average Luminance Level of 50\% or More} \times \text{Emission Time Value} \quad \text{(Equation 2)}$$

In Equation 2, the frame rate value is a parameter for determination which parameter reflects the magnitude of the frame rate S12 used for display driving of the organic EL panel module 11. The area value for an average luminance level of 50% or more is a parameter for determination which parameter reflects the magnitude of the area of a combined block region that has become an object of measurement of the emission time information S11. The emission time value is also a parameter for determination, which parameter reflects the measured time of the emission time information S11.

FIGS. 40 to 42 show an example of correspondence tables for converting the values into the corresponding parameters.

FIG. 40 shows an example of a table of correspondences between the frame rate and the frame rate value. When the frame rate is 65 Hz or higher, flicker is generally invisible. Thus, the frame rate in this range is associated with zero as a frame rate value. Incidentally, when the frame rate becomes lower than 65 Hz, flicker gradually becomes easier to see. Thus, the frame rate value is gradually increased. In the case of FIG. 40, when the frame rate is 54 Hz or lower, the frame rate value is "4," which is a maximum value.

FIG. 41 shows an example of a table of correspondences between the area of a high-luminance region and the area value. Needless to say, flicker is generally invisible when the area is 10% or less of the total display region. Thus, the area in this range is associated with zero as an area value. Incidentally, when the area becomes larger than 10%, flicker gradually becomes easier to see. Thus, the area value is gradually increased. In the case of FIG. 41, the correspondences are set in steps of 5% of the area of the total display region. When the area is 50% or more, the area value is "2," which is a maximum value.

FIG. 42 shows an example of a table of correspondences between the emission time of a detected high-luminance region and the emission time value. Needless to say, flicker is invisible even in a high-luminance region when the emission time of the high-luminance region is short. In FIG. 42, a limit value of the emission time is set at one second, and an emission time of less than one second is associated with zero as an emission time value. Incidentally, when the emission time becomes more than one second, flicker gradually becomes easier to see. Thus, the emission time value is gradually increased. In the case of FIG. 42, the correspondences are set in steps of 0.1 seconds. When the emission time is two seconds or more, the emission time value is "2," which is a maximum value.

Using the above correspondence tables, the flicker information calculating section 103 calculates flicker information S13.

Incidentally, the flicker information S13 assumes a value of zero when the frame rate is high, when the area of the high-luminance region (region whose average luminance level is 50% or more and whose area is 10% or more of the entire screen) is small, or when the continuous emission time of the high-luminance region is less than one second. Incidentally, a total emission time length is reflected at the time of determining the number of blocks, and a motion quantity is reflected at the time of determining the area of the high-luminance region. Thus, the flicker information S13 reflects all the conditions necessary for flicker determination.

(c) Peak Luminance Setting Section

The peak luminance setting section 85 (FIG. 28) determines a display mode (peak luminance level) and a driving mode on the basis of the detected flicker information S13 as well as ambient luminance information input from the luminance sensor 47, user input information, an average luminance level Yavr, program information, a display frame rate and the like. Incidentally, the driving mode in this case is included in a "display mode" in claims. In the following, the two terms are used in different manners to distinguish between selection of driving control based on a peak luminance level and selection of driving control based on a flicker component quantity.

Incidentally, the display mode (peak luminance level) may be determined by a method similar to that of the peak luminance setting section 43 in the foregoing embodiment. In addition, for example, when the display frame rate is lower than a determination threshold value, a display mode and a driving mode that reduce flicker may be selected forcibly irrespective of the above-described flicker information S13. A rate of 30 frames per second, for example, is used as the determination threshold value in this case. Thus, when an input image is a one-segment broadcast program, the display mode and the driving mode are forcibly set to a flicker remedying mode according to information indicating that the input image is a one-segment broadcast program.

Description in the following will be made of a method of setting the driving mode when the display frame rate is higher than the determination threshold value. FIG. 43 shows correspondences between the flicker information and the driving mode. In the case of FIG. 43, the lower the value of the flicker information S13, the lower the intensity of flicker, and the higher the value of the flicker information S13, the higher the intensity of flicker.

Thus, for an input image with a low intensity of flicker, the driving mode of a moving image improving system is selected. For an input image with a medium intensity of flicker, the driving mode of a balance system is selected. For an input image with a high intensity of flicker, the driving mode of a flicker remedying system is selected.

(d) Timing Generating Section

The timing generating section 87 (FIG. 28) determines timing of output of a maximum of six values of driving voltage so as to obtain the set peak luminance level for the set driving mode.

Figure 44A:
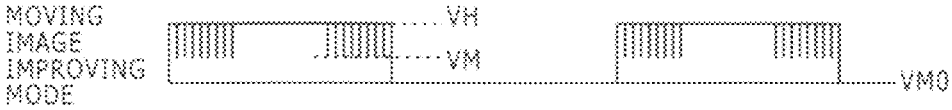
FIGS. 44A, 44B, and 44C are diagrams showing an example of patterns of output of driving voltages realized by generated timing pulses.
Figure 44B:
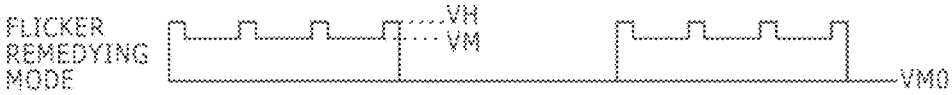
Figure 44C:
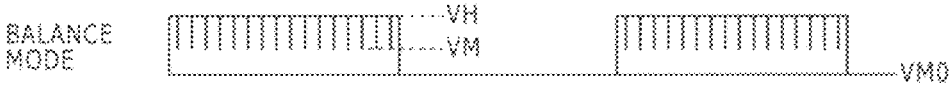

FIGS. 44A, 44B, and 44C show an example of patterns of output of driving voltages realized by generated timing pulses. Incidentally, FIGS. 44A, 44B, and 44C show an example of output patterns corresponding to the intermediate luminance mode in the first embodiment.

Figure 45A:
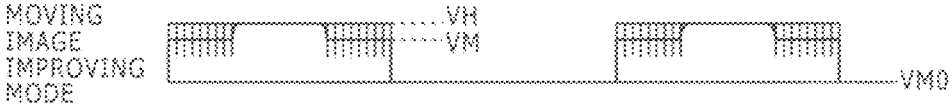
FIGS. 45A, 45B, and 45C are diagrams showing an example of appearance of luminance distributions corresponding to the example of the patterns of output of the driving voltages.

FIG. 44A shows an example of a pattern of output of driving power when the peak luminance level is 40% (240 nits) and the driving mode is the moving image improving mode. In the moving image improving mode, a luminance distribution is desirably arranged so as to concentrate in a particular period in order to avoid a moving image blur. Accordingly, in FIG. 44A, the output of a driving voltage having a waveform shaped in the form of a pulse is disposed in both end parts of an emission period. As a result, as shown by a thick line in FIG. 45A, the luminance distribution can be concentrated on the center side of the emission period. Because the luminance distribution concentrates in the center of the emission period, moving image blurs are difficult to perceive visually, and the visibility of moving images is improved.

Figure 45B:
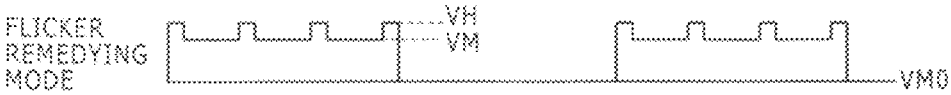

FIG. 44B shows an example of an output pattern when the peak luminance level is 40% (240 nits) and the driving mode is the flicker remedying mode. In the flicker remedying mode, the visibility of an image can be enhanced by increasing a blinking frequency. Accordingly, in FIG. 44B, four pulse outputs are arranged in a dispersed manner. As a result, as shown by a thick line in FIG. 45B, the luminance distribution can be dispersed over the whole of the emission period. Because an apparent frequency component is made higher, the visibility of a still image is improved. Incidentally, for the flicker remedying mode, an output pattern in the first embodiment can be applied as it is.

Figure 45C:
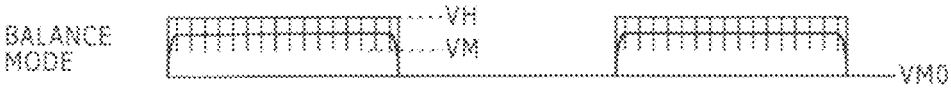

FIG. 44C shows an example of an output pattern when the peak luminance level is 40% (240 nits) and the driving mode is the balance mode. In the balance mode, the output of a driving voltage having a waveform shaped in the form of a pulse is arranged uniformly over the whole of the emission period. As a result, as shown by a thick line in FIG. 45C, the luminance distribution is decreased uniformly throughout the emission period.

(C-3) Summary

In the present embodiment, the driving mode can be selected according to the quantity of a flicker component included in an input image. Therefore the present embodiment can be applied not only to a case where the input image is a one-segment broadcast program but also to a case where the input image is another input image.

Of course, when the lowest luminance mode is selected in setting the peak luminance level, driving techniques similar to those of the first embodiment can be applied. When the lowest luminance mode is selected, power consumption can be reduced. Because power consumption is reduced, this driving technique exerts effects especially when incorporated into a portable type electronic device.

(D) Other Embodiments (D-1) Other Methods of Setting Peak Luminance Level

In the foregoing embodiment, description has been made of a case where the peak luminance level is set variably according to frame average luminance, the magnitude of ambient illuminance, and the like.

However, the peak luminance level can be set referring to other information. For example, the peak luminance level may be set variably on the basis of the ambient temperature of the organic EL panel module or environmental temperature. For example, when the temperature is low, the peak luminance level may be set high, and when the temperature is high, the voltage value of the peak luminance level may be set low.

In addition, the plurality of conditions described above may be combined with each other, and the peak luminance level may be set variably.

(D-2) Output Width of Pulse Output in Lowest Luminance Mode

In the foregoing embodiment, pulse output widths in the lowest luminance mode are all set identical with each other. However, a method of modulating pulse width may be combined. The modulation of pulse width as well as driving voltage amplitude enables finer control.

(D-3) Number of Times of Pulse Output in Lowest Luminance Mode

In the foregoing embodiment, description has been made of a case where pulse output is produced four times in the lowest luminance mode. However, the number of times of output is not limited to four, but may be two, three, five or more. Incidentally, in the case of the organic EL display panel, one of times of pulse output is used for mobility correcting operation in the non-emission period, and therefore two times or more of pulse output within the emission period is advantageous from a viewpoint of a measure against flicker. In addition, an appropriate number of times is desirably set according to the display frame rate.

(D-4) Output Intervals of Pulse Output in Lowest Luminance Mode

In the foregoing embodiment, description has been made of a case where pulse output is produced at equal intervals in the lowest luminance mode.

However, the intervals of pulse output may be varied. In the second embodiment, in particular, pulse output intervals may be variably controlled according to the driving mode at the time of the lowest luminance mode.

In the moving image improving mode, for example, the luminance distribution may be concentrated at a particular position by narrowing pulse output intervals in the lowest luminance mode. Thereby a moving image blur in the lowest luminance mode can be reduced. In the balance mode, for example, the number of times of pulse output in the lowest luminance mode may be increased, and pulse output intervals may be made wider than in the moving image improving mode. Thereby a moving image blur in the lowest luminance mode can be reduced.

(D-5) Example of Other Display Devices

In the foregoing embodiment, description has been made of a case where the invention is applied to an organic EL panel module.

However, the above-described driving techniques can also be applied to other emissive type display panel modules. For example, the driving techniques can also be applied to a display device in which LEDs are arranged and another display device in which light emitting elements having a diode structure are arranged on a screen. For example, the driving techniques can also be applied to a display panel module in which inorganic EL elements are arranged in the form of a matrix.

(D-6) Product Examples (Electronic Devices)

The above-described driving voltage applying techniques are distributed not only in the form of a display panel module but also in the form of products mounted in various electronic devices. Examples of mounting into electronic devices will be shown in the following.

Figure 46:
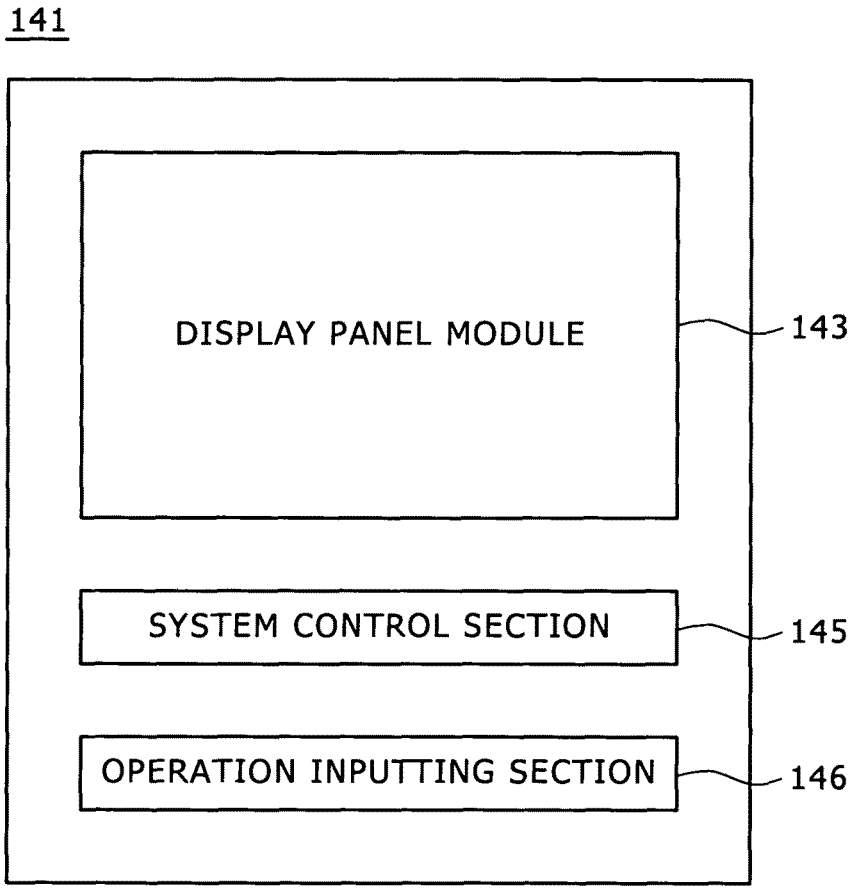
FIG. 46 is a diagram showing an example of functional configuration of an electronic device.

FIG. 46 shows an example of conceptual configuration of an electronic device 141. The electronic device 141 includes a display panel module 143 employing the above-described driving voltage applying techniques, a system controlling section 145, and an operating input section 147. Details of processing performed by the system controlling section 145 differ depending on the product form of the electronic device 141. The operating input section 147 is a device for receiving an operating input to the system controlling section 145. For example, a switch, a button, and other mechanical interfaces, a graphics interface, and the like are used as the operating input section 147.

Incidentally, the electronic device 141 is not limited to devices in a specific field as long as the electronic device 141 has a function of displaying images or video generated within the device or input externally.

Figure 47:
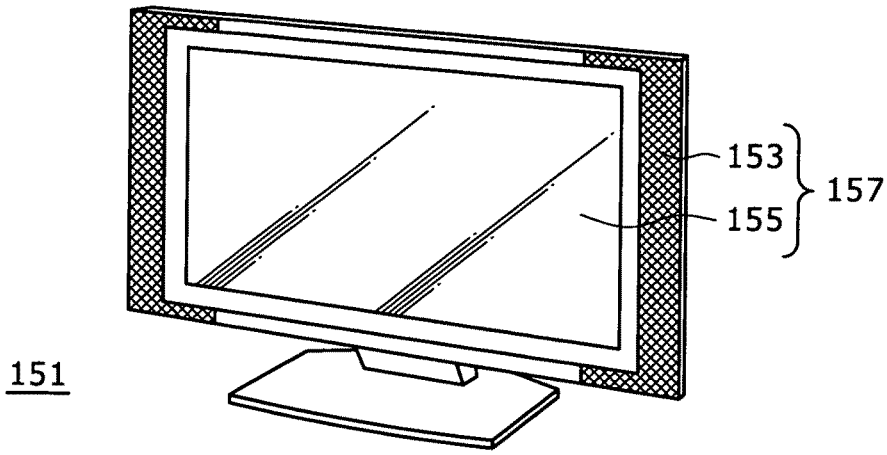
FIG. 47 is a diagram showing an example of a product of an electronic device.

FIG. 47 shows an example of external appearance in a case where another electronic device is a television receiver. A display screen 157 composed of a front panel 153, a filter glass 155 and the like is disposed in the front surface of a casing of the television receiver 151.

Figure 48A:
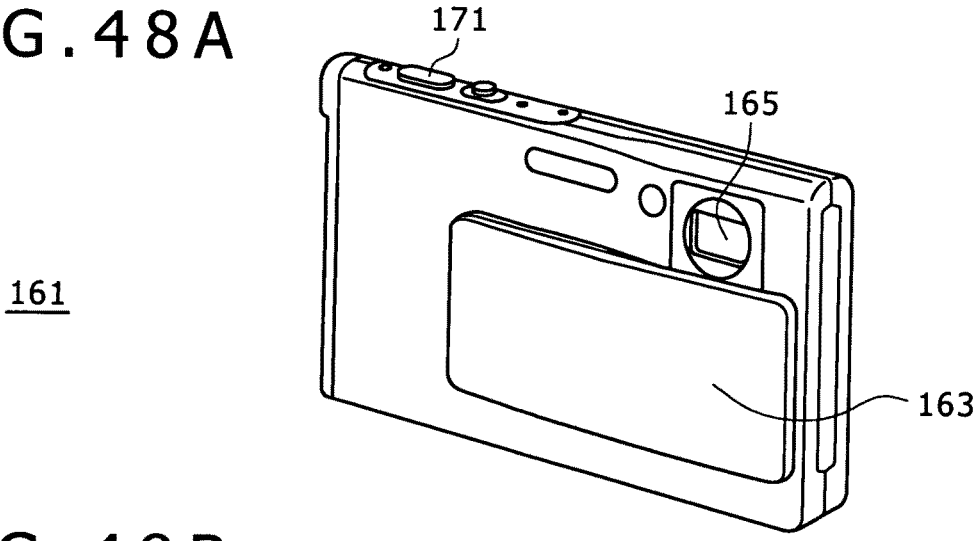
FIGS. 48A and 48B are diagrams showing an example of a product of an electronic device.
Figure 48B:
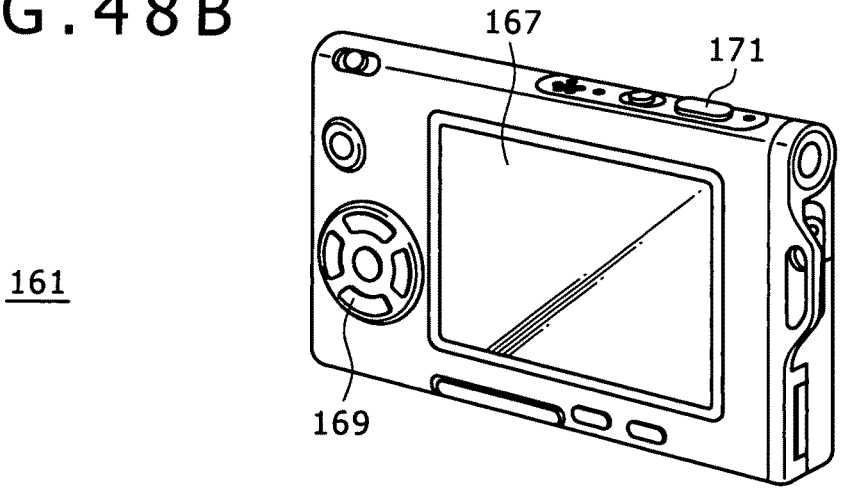

In addition, a digital camera, for example, is assumed as this kind of electronic device 141. FIGS. 48A and 48B show an external appearance of the digital camera 161. FIG. 48A shows an example of external appearance of a front side (subject side). FIG. 48B shows an example of external appearance of a back side (photographer side). The digital camera 161 includes a protective cover 163, an image pickup lens section 165, a display screen 167, a control switch 169, and a shutter button 171.

Figure 49:
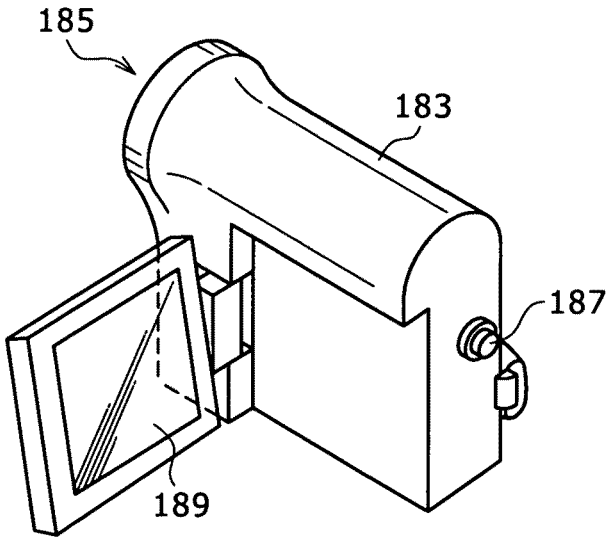
FIG. 49 is a diagram showing an example of a product of an electronic device.

In addition, a video camera, for example, is assumed as this kind of electronic device 141. FIG. 49 shows an example of external appearance of the video camera 181.

The video camera 181 includes an image pickup lens 185 for picking up an image of a subject in the front of a main unit 183, a start/stop switch 187 for picture taking, and a display screen 189.

Figure 50A:
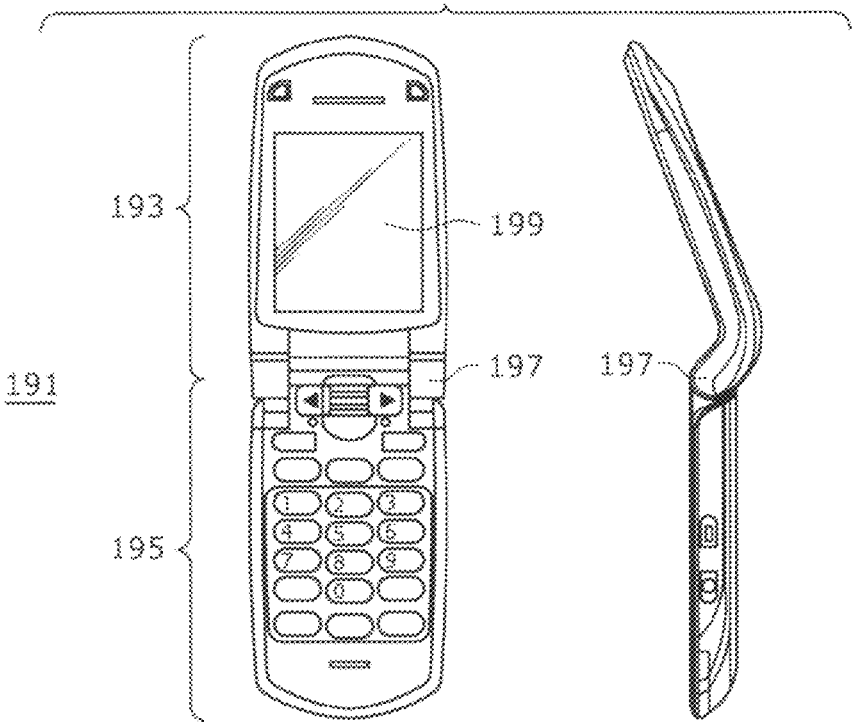
FIGS. 50A and 50B are diagrams showing an example of a product of an electronic device.
Figure 50B:
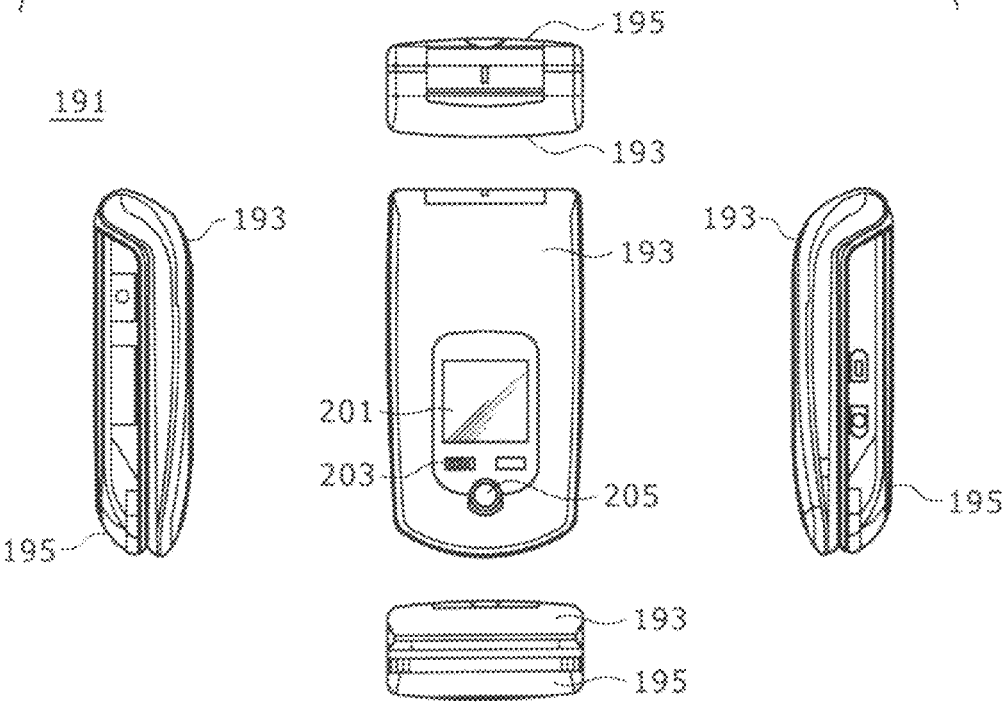

In addition, a portable terminal device, for example, is assumed as this kind of electronic device 141. FIGS. 50A and 50B show an example of external appearance of a portable telephone 191 as the portable terminal device. The portable telephone 191 shown in FIGS. 50A and 50B is a folding type. FIG. 50A shows an example of external appearance in a state of a casing being opened. FIG. 50B shows an example of external appearance in a state of the casing being closed.

The portable telephone 191 includes an upper side casing 193, a lower side casing 195, a coupling part (a hinge part in this example) 197, a display screen 199, an auxiliary display screen 201, a picture light 203, and an image pickup lens 205.

Figure 51:
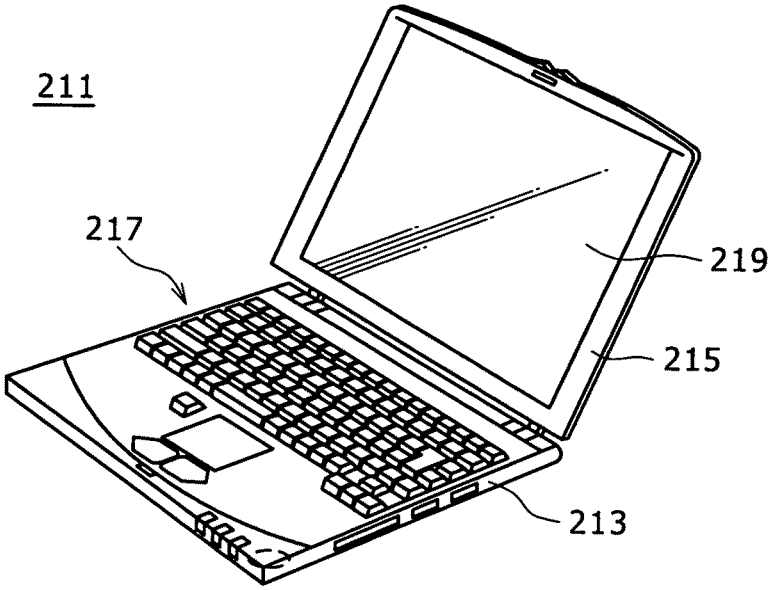
FIG. 51 is a diagram showing an example of a product of an electronic device.

In addition, a computer, for example, is assumed as this kind of electronic device 141. FIG. 51 shows an example of external appearance of a notebook computer 211.

The notebook computer 211 includes a lower side casing 213, an upper side casing 215, a keyboard 217, and a display screen 219.

In addition to the above, an audio reproducing device, a game machine, an electronic book, an electronic dictionary and the like are assumed as electronic device 141.

(D-7) Others

Various examples of modification of the foregoing embodiments can be considered without departing from the spirit of the invention. In addition, various examples of modification and various examples of application created or combined on the basis of the description of the present specification can also be considered.

The present application contains subject matter related to that disclosed in Japanese Priority Patent Application JP 2008-321653 filed in the Japan Patent Office on Dec. 17, 2008, the entire content of which is hereby incorporated by reference.

What is claimed is:

1. An emissive type display device comprising:

a pixel array section having pixels arranged in an active matrix driving system;

a circuit configured to provide a set peak luminance level of one frame period; and a driving circuit configured to variably control a total application period length of a driving voltage applied to a power supply line connected to a driving transistor of respective ones of the pixels and amplitude of the driving voltage so as to obtain the set peak luminance level, when the set peak luminance level is lower than a set value, the driving circuit configured to divide the driving voltage into a pulse waveform having a plurality of pulses in the one frame period, and configured to variably control the amplitude of the driving voltage according to the set peak luminance level such that amplitude of at least one of the plurality of pulses is lower than a maximum driving voltage.

2. The emissive type display device according to claim 1, wherein when a plurality of display modes are selectable and a display mode determining section selects one of the plurality of display modes, control by said driving circuit is performed.

3. The emissive type display device according to claim 2, wherein the display mode determining section selects the one of the plurality of display modes when a display frame rate is lower than a determination threshold value.

4. The emissive type display device according to claim 1, the driving circuit controls the amplitude of the plurality of pulses such that the amplitude of the plurality of pulses is decreased gradually towards an end of the one frame period, first one of the plurality of pulses being the maximum driving voltage.

5. The emissive type display device according to claim 4, wherein when the pixel array section is an electro luminescence light emitting device, the maximum driving voltage is a voltage applied at a time of correction of a mobility characteristic.

6. The emissive type display device according to claim 1, wherein widths of the plurality of pulses are all identical to each other.

7. The emissive type display device according to claim 1, wherein the plurality of pulses are disposed at equal intervals in the one frame period.

8. The emissive type display device according to claim 1, wherein a number of the plurality of pulses is set according to a display frame rate.

9. The emissive type display device according to claim 1, wherein the driving voltage is a fixed voltage, which is smaller than the maximum driving voltage, during a non-emission period.

10. A semiconductor device comprising:

a driving circuit for, in variably controlling a total application period length of a driving voltage applied to a power supply line connected to a driving transistor of each pixel forming a pixel array section and amplitude of the driving voltage so as to obtain a set peak luminance level, when the set peak luminance level is lower than a set value, dividing the driving voltage into a pulse waveform having a plurality of pulses in one frame period, and variably controlling the amplitude of the driving voltage according to the set peak luminance level such that the amplitude of at least one of the plurality of pulses is lower than a maximum driving voltage.

11. An electronic device comprising:

a pixel array section having pixels ready for an active matrix driving system;

a first driving circuit for driving a signal line;

a second driving circuit for controlling an operation of writing a potential of said signal line to each pixel forming said pixel array section;

a circuit for providing a set peak luminance level of each display frame;

a third driving circuit for variably controlling a total application period length of a driving voltage applied to a power supply line connected to a driving transistor of each pixel and amplitude of the driving voltage so as to obtain the set peak luminance level, when the set peak luminance level is lower than a set value, the third driving circuit dividing the driving voltage into a pulse waveform having a plurality of pulses in one frame period, and variably controlling the amplitude of the driving voltage according to the set peak luminance level such that the amplitude of at least one the plurality of pulses is lower than a maximum driving voltage;

a system controlling section configured to control operation of an entire system; and an operating input section configured to receive an operating input to said system controlling section.

12. A method of driving a power supply line disposed in an emissive type display device, said method comprising:

in variably controlling a total application period length of a driving voltage applied to the power supply line connected to a driving transistor of each pixel forming a pixel array section and amplitude of the driving voltage so as to obtain a set peak luminance level, dividing the driving voltage into a pulse waveform having a plurality of pulses in one frame period when the set peak luminance level is lower than a set value; and variably controlling the amplitude of the driving voltage according to the set peak luminance level such that the amplitude of at least one of the plurality of pulses is lower than a maximum driving voltage.

* * * * *